US008567470B2

(12) United States Patent
Kron et al.

(10) Patent No.: US 8,567,470 B2
(45) Date of Patent: Oct. 29, 2013

(54) METHOD AND APPARATUS FOR REMOVING A FILM FROM A SURFACE

(75) Inventors: Ryan E. Kron, Racine, WI (US); Nathan E. Ludtke, Waterford, WI (US); Lance D. Brown, Racine, WI (US); Douglas S. Rodenkirch, Sun Prairie, WI (US); Stephen A. Latham, Sun Prairie, WI (US); Daniel R. Bullis, Jr., Madison, WI (US)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/596,950

(22) Filed: Aug. 28, 2012

(65) Prior Publication Data

US 2012/0318464 A1 Dec. 20, 2012

Related U.S. Application Data

(63) Continuation of application No. 12/863,966, filed as application No. PCT/US2009/031839 on Jan. 23, 2009, now Pat. No. 8,251,117.

(60) Provisional application No. 61/023,351, filed on Jan. 24, 2008.

(51) Int. Cl.
*B32B 38/00* (2006.01)

(52) U.S. Cl.
USPC ..... 156/762; 156/715; 156/717; 156/759; 254/203; 254/209; 254/199; 254/200; 254/202; 254/208; 254/210; 254/211; 254/213; 254/219; 254/227; 254/242; 254/262; 16/5; 269/53; 269/54.5; 294/8.6; 294/103.1; 294/104; 294/119.1; 294/902

(58) Field of Classification Search
USPC ..... 254/199, 200, 202, 203, 208, 209, 210, 254/211, 213, 219, 227, 242, 262; 294/8.6, 294/103.1, 104, 119.1, 902; 269/53, 54.5; 16/5; 156/715, 717, 759, 762
See application file for complete search history.

(56) References Cited

U.S. PATENT DOCUMENTS

| | | | | |
|---|---|---|---|---|
| 4,394,052 | A | 7/1983 | Adams et al. | |
| 4,948,451 | A | 8/1990 | Foltz | |
| 5,851,618 | A | 12/1998 | Liddell et al. | |
| 6,004,426 | A * | 12/1999 | Johnson | 156/717 |

(Continued)

FOREIGN PATENT DOCUMENTS

| | | | |
|---|---|---|---|
| DE | 3002831 | A1 * | 7/1981 |
| DE | 29810100 | U1 * | 9/1998 |

(Continued)

*Primary Examiner* — Mark A Osele
*Assistant Examiner* — Nickolas Harm
(74) *Attorney, Agent, or Firm* — Michael Best & Friedrich LLP

(57) ABSTRACT

A tool and method for removing a film from a surface is provided, wherein the tool can include a frame, a handle operably coupled to the frame, a number of wheels operably coupled to the frame, a cylinder rotatably coupled to the frame, an arm rotatably coupled to the frame, and a number of separating devices operably coupled to the arm. In some embodiments, the wheels can rotate about one or more axes parallel to the surface. The cylinder, which collects the removed film, rotates about an axis that can also be parallel to the surface. The arm can rotate about an axis that can also be parallel to the surface.

20 Claims, 35 Drawing Sheets

(56) References Cited

U.S. PATENT DOCUMENTS

| | | | | |
|---|---|---|---|---|
| 6,227,479 | B1 * | 5/2001 | Dean et al. | 242/546.1 |
| 6,343,981 | B1 | 2/2002 | Buchanan | |
| 7,299,846 | B2 * | 11/2007 | Peirce | 156/759 |
| 2002/0108720 | A1 | 8/2002 | Fitterer | |
| 2003/0188833 | A1 * | 10/2003 | Adleman Jr | 156/584 |
| 2007/0222274 | A1 | 9/2007 | Manners | |

FOREIGN PATENT DOCUMENTS

| | | | |
|---|---|---|---|
| DE | 19808931 | A1 * | 9/1999 |
| JP | H11199802 | | 7/1999 |
| JP | 2004231823 | | 8/2004 |
| JP | 2007056256 | | 3/2007 |
| WO | 92/03290 | | 3/1992 |

* cited by examiner

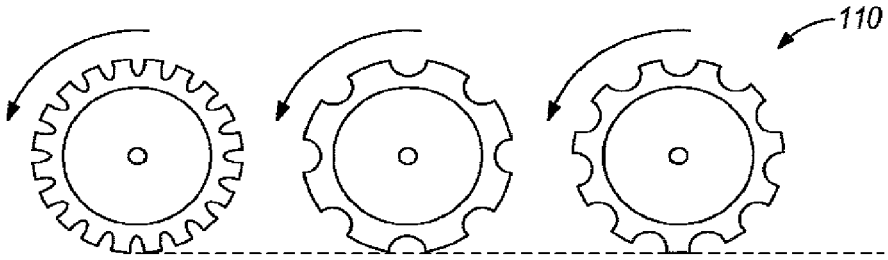
FIG. 20
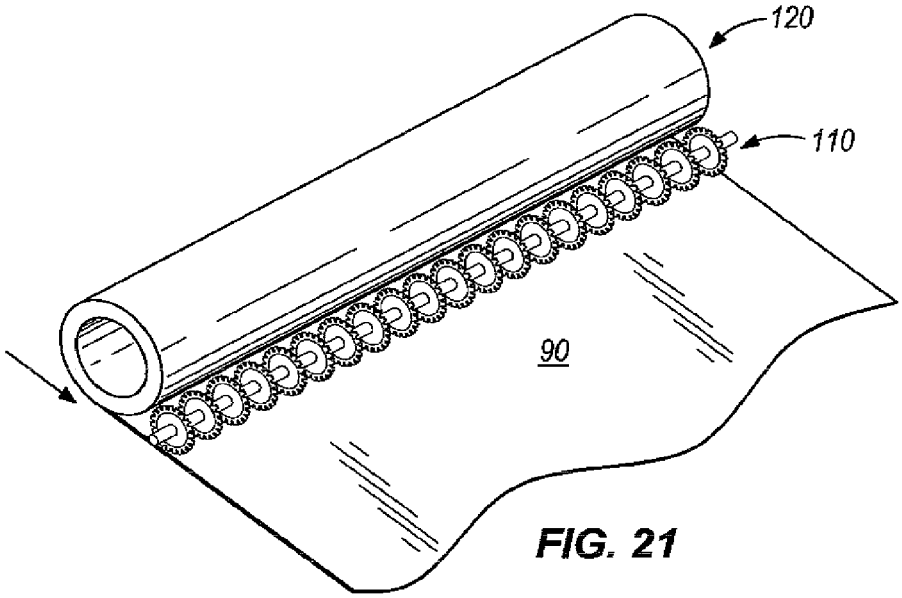
FIG. 21
FIG. 22
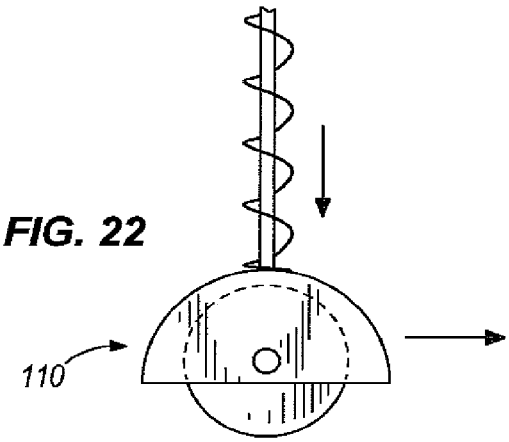

METHOD AND APPARATUS FOR REMOVING A FILM FROM A SURFACE

CROSS-REFERENCE TO RELATED APPLICATIONS

This application is a continuation of U.S. patent application Ser. No. 12/863,966, filed Jul. 21, 2010, which is a U.S. national phase application filing of International Patent Application No. PCT/US2009/031839, filed Jan. 23, 2009, which claims the benefit of and priority to U.S. Provisional Patent Application No. 61/023,351, filed Jan. 24, 2008, the entire contents of each of which are incorporated herein by reference.

BACKGROUND

A wide variety of coating types exist for covering floors and other surfaces. Although this variety presents more options for users than ever before, it also presents unique challenges in a number of cases. For example, the ability to quickly and efficiently remove a number of different floor finishes can be a significant challenge for many types of surface coatings. To date, coatings are often removed by stripping agents, tools (e.g., scrapers and other bladed instruments), or in other relatively labor-intensive processes.

The introduction of new coatings that can be mechanically removed from a floor surface by peeling presents additional difficulties that conventional tools do not adequately address, including the ability to start and continue peeling operations of such coatings, and the ability to quickly and easily collect the peeled coating during and following removal from a floor surface.

Accordingly, new floor coating removal tools continue to be welcome additions to the art.

SUMMARY

Described herein are, among other things, tools and methods for removing polymeric coatings or films from a surface, such as a floor surface.

In some embodiments of the present invention, a tool for removing a film from a surface is provided. The tool can include a frame; a handle coupled to the frame; at least one lever pivotably attached to the handle; a plurality of wheels coupled to the frame, each of the wheels rotatable about a respective axis; an arm rotatably coupled to the frame; a cylinder rotatably coupled to the frame and positioned to collect film from the surface; and at least one blade coupled to the frame and movable into contact with the surface, wherein the blade is coupled to the at least one lever such that moving the at least one lever changes the position of the blade relative to the surface Some embodiments of the present invention provide a method of removing a film from a surface, wherein the method includes making an alteration in a portion of the film comprising at least one of a score, an indentation, and a perforation; lifting the film from the surface in a region near the alteration; and rolling the film onto a cylinder.

In other embodiments of the present invention, a tool for removing film from a surface is provided. The tool includes a frame; a handle coupled to the frame; a plurality of wheels coupled to the frame, each of the wheels rotatable about a respective axis; an arm rotatably coupled to the frame; a cylinder rotatably coupled to the arm and positioned to collect film from the surface; a resiliently flexible base removably coupled to the frame; and at least one blade coupled to the base.

BRIEF DESCRIPTION OF THE DRAWINGS

FIGS. 15-24, 27A, 27B, and 31 show blades and related elements of film removal tools according to some embodiments of the present invention.

DETAILED DESCRIPTION

Figure 1A:
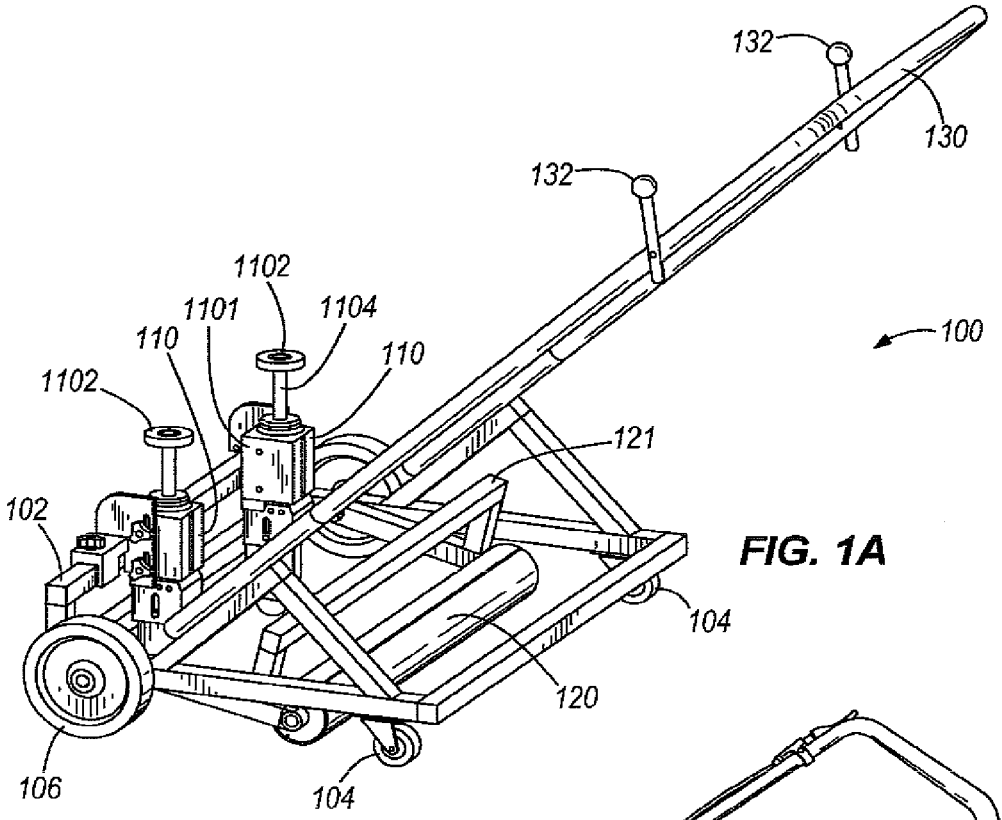
FIGS. 1A and 1B are perspective views of film removal tools according to embodiments of the present invention.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance. The use of "including," "comprising," or "having" and variations thereof herein is meant to encompass the items listed thereafter and equivalents thereof as well as additional items. Unless limited otherwise, the terms "connected," "coupled," and variations thereof herein are used broadly and encompass direct and indirect connections and couplings. In addition, the terms "connected" and "coupled" and variations thereof are not restricted to physical or mechanical connections or couplings.

Various embodiments of tools 100 designed to remove peelable coatings or films 90 from a floor or other surface 92 and methods for removing such material from a floor or surface 92 are described and/or illustrated herein. The tools 100 can be operated on a surface 92 such as a floor, which has a peelable film 90 applied thereto.

The peelable film 90 can comprise one or more layers of a polymeric composition applied to a surface 92 in a manner that allows the film 90 to be peeled from the surface 92. U.S. Pat. No. 5,851,618, incorporated herein by reference in its entirety, describes peelable floor coating systems that generate films 90 that the tool 100 can be used to remove.

Other types of peelable floor coating systems that can be removed using the various tools herein are described in co-pending U.S. Provisional Patent App. No. 60/938,611 filed on May 17, 2007, U.S. Provisional Patent App. No. 60/957,982 filed on Aug. 24, 2007, and U.S. Provisional Appl. No. 61/011,957, filed on Jan. 23, 2008, each of which is incorporated herein by reference in its entirety.

In some embodiments, the method by which the peelable film 90 is applied to the surface 92 includes: applying a sealer coating to the surface 92 and allowing the sealer coating to dry; applying one or more intermediate coatings on top of the sealer coating; allowing the intermediate coatings to dry; and applying one or more maintenance coatings on top of the intermediate coating(s). In some embodiments, the intermediate coating(s) can have a tensile strength at break of at least 100 psi when dry.

The sealer coating can be comprised of chemically-strippable polymeric film that can be applied to the upper surface of a flooring substrate or surface 92. Exemplary sealer coatings can include a water-borne styrene-acrylic based composition. Commercially available sealers can include IRONSTONE floor sealer from Butchers, Sturtevant, Wis.; PLAZA PLUS finish from JohnsonDiversey, Sturtevant, Wis.; and FLOOR SEALER from Betco Corp, Toledo, Ohio.

Each intermediate (or peelable) coating can be comprised of at least one film-former having solid levels of at least about 35 wt %, and optionally plasticizers from about 0 to about 10 wt %, wetting agents from about 0 to about 10 wt %, coalescents from about 0 to 5%, defoamers from about 0 to about 5 wt %, and waxes from about 0 to about 20 wt %. Other additives such as fragrances, dyes, pigments, preservatives, neutralizing agents, and other additives typical of coatings known by those skilled in the art can also be included. Additionally, release aids can be added to the coating composition to assist in peeling of the intermediate coating from the sealer coating.

Each maintenance coating can be, for example, a water-borne styrene-acrylic based composition exhibiting compatibility and durability properties with the intermediate coating (s) such that it provides further aesthetic enhancement, as well as a surface that can be easily maintained by routine cleaning, buffing, or other maintenance procedures commonly known to one skilled in the art. Examples of commercially available maintenance coatings include SIGNATURE finish from JohnsonDiversey, Inc., Sturtevant, Wis., AMPLIFY finish from Butchers, Co., Sturtevant, Wis., ISHINE finish from Spartan Chemical Company of Maumee, Ohio, and CASTLEGUARD finish from Buckeye International of Maryland Heights, Mo.

FIGS. 1A-5 illustrate a tool 100 for removing film 90 according to an embodiment of the present invention. The illustrated tool 100 includes a frame 102, a handle 130 coupled to the frame 102 for controlling and pushing the tool 100 across the floor or other surface 92, a blade 110 directly or indirectly coupled to the frame 102 and positioned to score or perforate the film 90, and a roller 120 that pulls the film 90 from the floor or other surface 92 and rolls it onto a tube 122.

Figure 8:
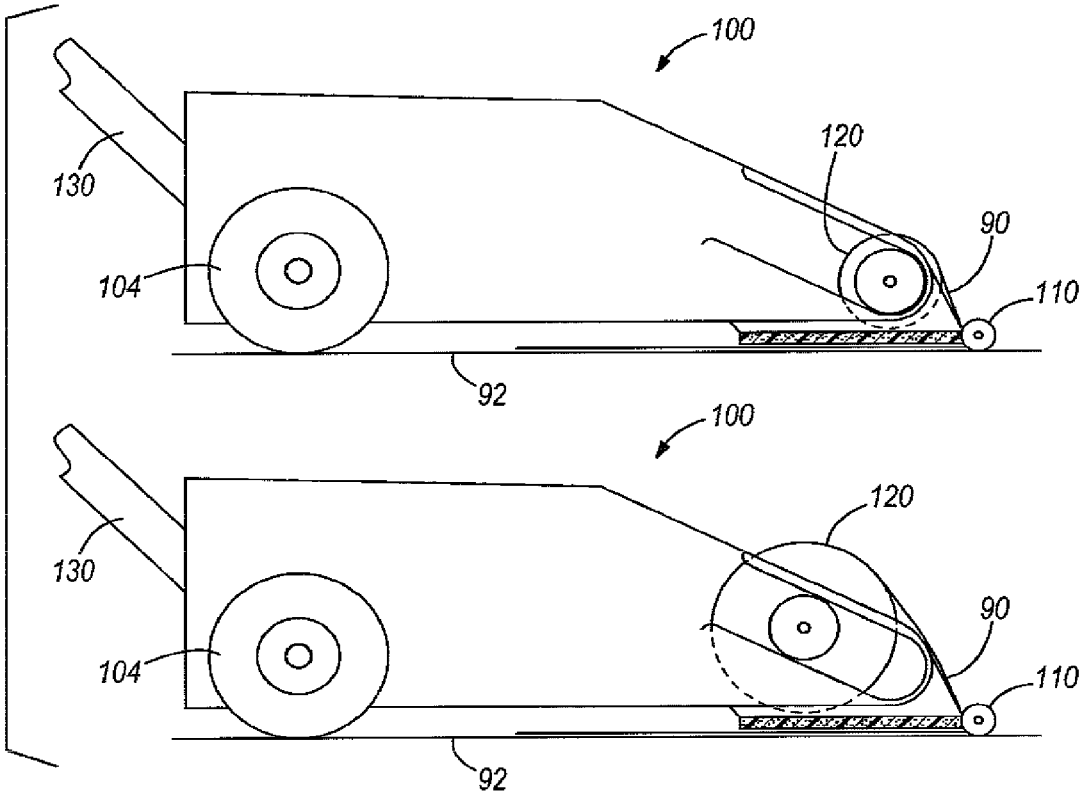
FIG. 8 shows a film removal tool according to another embodiment of the present invention, with the film removal tool illustrated in two different states of operation.
Figure 9:
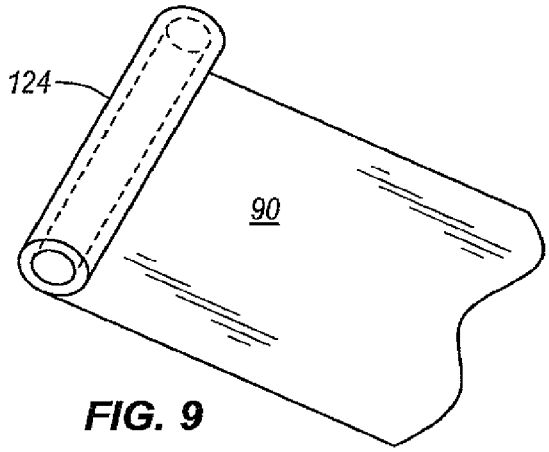
FIG. 9 shows a tube of film removal tools according to some embodiments of the present invention, shown in a state winding up film.

In some embodiments, the tool 100 has one or more wheels 104, 106 coupled to the frame 102. The rear wheels 104 of the embodiment of FIGS. 1A-5 are casters that are pivotably connected to the frame 102, although other types of wheels can be used as well. In the embodiment of FIGS. 1A-5, the front wheels 106 are shown attached to the frame 102 in a non-pivoting manner, although they can also be pivotable. Thus, the tool 100 shown in FIGS. 1A-5 rolls on the rear wheels 104 at a rearward end and on the front wheels 106 at a frontward end. In other embodiments, the underside of the tool 100 can be supported at least in part by a pad of non-woven material such as felt (see FIG. 8), one or more pads, blocks, or other elements of low-friction material (e.g., TEFLON® or DELRIN® both available from E.I. du Pont de Nemours and Company), UHMW plastic, and the like. In still other embodiments, the tool 100 can move be supported and moved on a combination of one or more wheels and the roller 120.

The handle 130 or other control device can be mounted at the rear end of the tool 100, or to any other location on the tool 100 as well, such as on the side, top, or front of the tool 100. The position of the handle 130 can also be adjustable so that the handle 130 can be moved to various locations relative to the rest of the tool 100, depending for example upon the locations of walls or other environmental obstacles about the tool 100 in use.

With continued reference to the embodiment of FIGS. 1A-5, the roller 120 is also attached to the frame 102, which in the illustrated embodiment has a tube 122 thereon. The illustrated roller 120 is coupled to the frame 102 via a roller support arm 121. The roller support arm 121 can be pivotably attached to the frame 102 such that the roller 120 can be in contact with the surface 92. In some embodiments, the roller 120 rotates relative to the roller support arm 121, such that pushing the tool 100 forward forces the roller 120 to rotate and gather film 90 from the surface 92. The roller support arm 121 can remain in contact with the surface 92 by gravity or, as shown in the embodiment of FIGS. 1A-5, additional biasing force can be applied to the roller support arm 121 to press and hold the arm 121 against the surface 92. For example, in the embodiment illustrated in FIGS. 1A-5, at least one torsion spring 1211 is disposed at or near the pivoting mechanism between the arm 121 and the frame 102 so as to bias the arm 121 towards the surface 92. Other biasing mechanisms, such as leaf springs, coil springs, elastic bands, and other types of spring mechanisms can also be used (hereinafter referred to collectively as a "spring").

In some embodiments, the tube 122 can be removably attached to the roller 120, such as by unbolting the roller 120 from the frame 102 and sliding or cutting the tube 122 off of the roller 120. The tube 122 with removed film 90 can then be discarded or recycled.

In the embodiment shown in FIGS. 1A-5, the roller 120 is attached to the roller support arm 121 by a quick-connect device. The quick-connect device includes a pin that holds the roller 120 onto the roller support arm 121, such that removing the pin allows the roller 120 to be slid off the roller support arm 121. The pin can include a retention mechanism such as a ball bearing along its shaft to keep the pin from falling off of the roller support arm 121, e.g. due to vibration, during use of the tool 100.

In some embodiments, the roller 120 and roller support arm 121 can be manually lifted away from the surface 92, for example to remove the roller 120. To maintain the roller support arm 121 in an elevated position away from the surface 92, the illustrated roller support arm 121 includes a knob 1222 attached to a pair of rods 1223 (see, e.g., FIGS. 1D and 4). Rotating the knob 1222 in one direction pushes the rods 1223 outward so that the rods 1223 engage with the handle 130 of the tool 100 and hold the roller support arm 121 in an elevated position (FIG. 1D). Rotating the knob 1222 in an opposite direction pulls the rods 1223 inward, disengaging them from the handle 130, and allowing the roller support arm 121 to pivot downwards until the roller 120 contacts the surface 92. Although a knob and rod mechanism is used in the illustrated embodiments, it will be appreciated that a number of other mechanisms can be used to maintain the roller 120 elevated upon the frame 102 or other portion of the tool 100. By way of example only, one or more hooks, latches, strings, or springs can be used to attach the roller support arm 121 to the handle 130, or the roller support arm 121 can be hooked, latched, or tied to another part of the tool 100 to maintain the roller support arm 121 in an elevated position.

In some embodiments, the film 90 is attached directly to the roller 120 without an intervening tube 122, in which case the roller 120 can comprise a hollow or solid cylinder 124 onto which the film 90 is rolled. In such embodiments, the film 90 can be removed from the cylinder 124 and discarded or recycled. Also, in some embodiments, the cylinder 124 (or the outer surface thereof) can be made of a material having a low coefficient of friction, such as felt, TEFLON® or DELRIN® both available from E.I. du Pont de Nemours and Company, UHMW, and the like, to make it easier to slide the film 90 off the end of the cylinder 124 rather than unwind the film 90.

Figure 10:
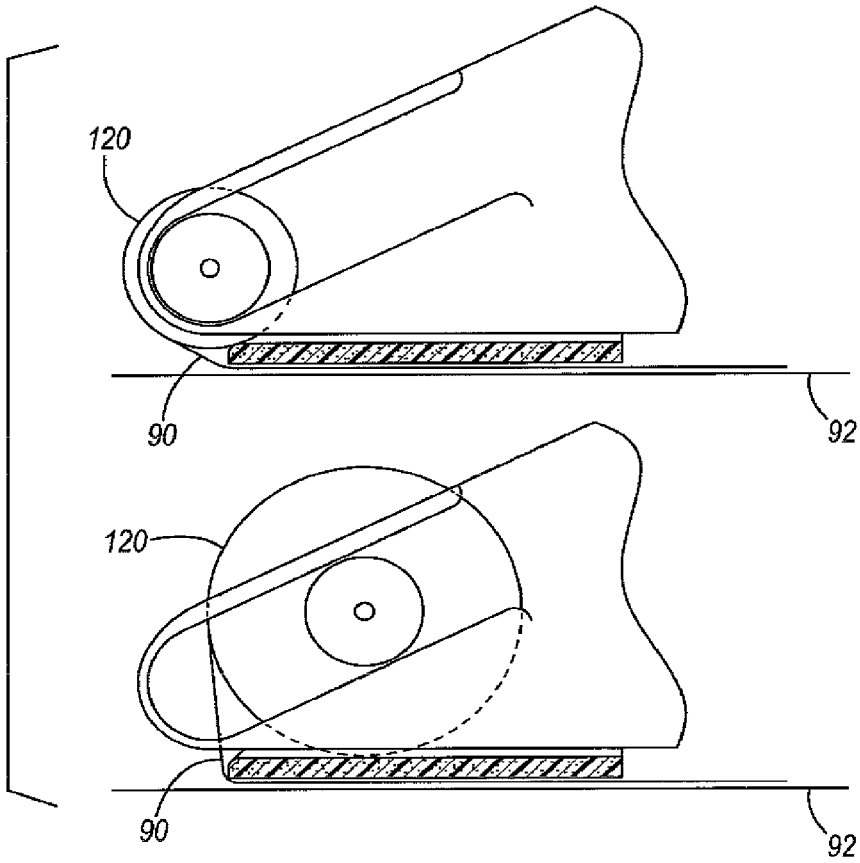
FIG. 10 shows detail views of the film removal tool similar to that shown in FIG. 8.
Figure 11:
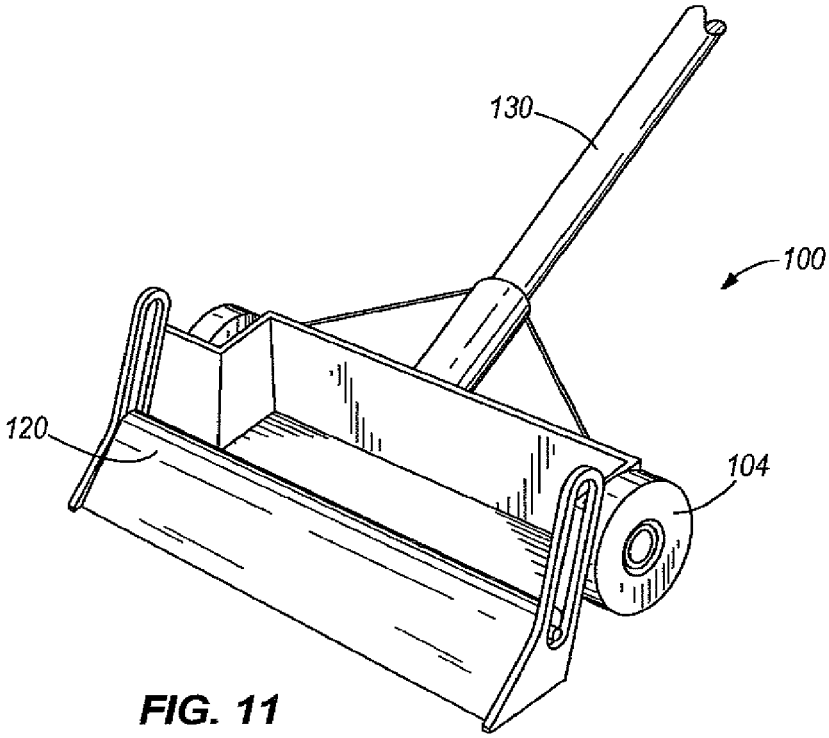
FIG. 11 shows a film removal tool according to another embodiment of the present invention.

In some embodiments, the roller 120 comprises a cylinder 124 on which the removed film 90 collects either directly or upon a tube 122 received on the cylinder 124 (as described above). The roller 120 can also include an axle and other elements or mechanisms permitting the cylinder 124 to rotate. In some embodiments, such as the illustrated embodiment of FIGS. 1A-5, the cylinder 124 rotates about an axis that is parallel to the surface 92 from which the film 90 is being removed. The axis of rotation can be perpendicular to the direction of movement of the tool 100. In some embodiments (see FIGS. 1A-5), the tube 122 and/or the cylinder 124 is in contact with the floor or other surface 92, such that movement of the tool 100 across the surface 92 provides the necessary rotational force on the cylinder 124 to roll up the film 90 as it is removed.

Where the roller mechanism 120 comprises a tube 122 and/or cylinder 124, and particularly where the tube 122 or cylinder 124 rolls on the surface 92 collecting the removed film 90, one or more pieces of low-friction material can be mounted under the outer edges of the tube 122 and/or cylinder 124 to facilitate smooth movement (FIGS. 8, 9, 10, 11) over the floor surface. Such low-friction material can include, without limitation, pads of felt, pieces of TEFLON® or DELRIN® both available from E.I. du Pont de Nemours and Company, pieces of UHMW, and the like. In addition, the rotating mechanism of the tube 122 or cylinder 124 can be height-adjustable, such as by being retained in a vertical or angled slot, since the diameter of the tube 122 or cylinder 124 increases as more film 90 is collected (see FIGS. 8, 10, 11).

In those embodiments in which a separate tube 122 is employed, the tube 122 can be received on the roller 120, which can be rotatably attached to the frame 102 of the tool 100, or which can be stationary with respect to the frame 102 to permit the tube 122 to rotate about the tube 122. The tube 122 may be rotatably attached to the frame 102 in a number of different manners. For example, the tube 122 can slide over a cylinder 124 (see FIG. 5), which can be stationary or rotatably attached to the frame 102 as just described. In other embodiments, instead of a cylinder 124, the tube 122 can be supported by longitudinal members having other cross-sectional shapes, such as hexagonal, octagonal, or other shapes that can support a tube 122.

In embodiments in which the tube 122 is supported by a cylinder 124, the tube 122 can be made from a less rigid material, since the underlying cylinder 124 can maintain the tube 122 in a shape suitable for rolling up the film 90. Thus, the tube 122 can be as simple as a piece of paper or plastic wrapped around the cylinder 124, which can then be cut from or slid off the cylinder 124 at a later time (e.g., when the film 90 has been wound upon the tube 122). In some embodiments, the tube 122 is a plastic heat-shrinkable sleeve, so that it can be shrunk onto the cylinder 124 to provide a tight fit. Also in some embodiments, the film 90 can more readily attach to a plastic sleeve than to a paper sleeve due to friction between the film 90 and the plastic sleeve, and in some embodiments can be attached to the sleeve even without the use of adhesives.

In some embodiments, (see FIGS. 6A, 6B), the outer surface of the cylinder 124 is provided with one or more longitudinal grooves 128 (i.e., running parallel to the axis of rotation of the cylinder 124) which provide at least one location for slicing the film 90 and sleeve/tube 122 from the cylinder 124 (particularly if the sleeve/tube 122 comprises a single sheet of paper or plastic or is otherwise relatively thin) without damaging the outer surface of the cylinder 124.

Figure 6A:
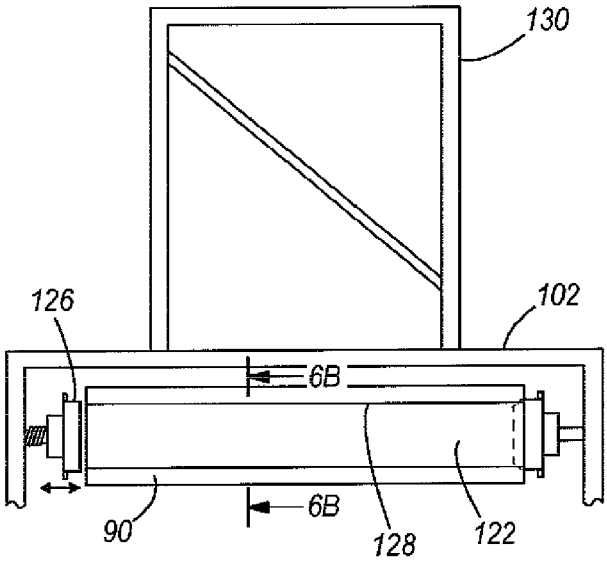
FIG. 6A is front view of a tool having a tube removably connected by way of a pair of end caps.
Figure 6B:
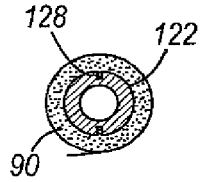
FIG. 6B shows a cross-section of the tube shown in FIG. 6A.

Although the tool 100 can have a cylinder 124 rotatable about an axle, in some embodiments, the tube 122 is rotatably attached to the frame 102 by a pair of rotating end caps 126 that fit into the ends of the tube 122 (see FIG. 6A). In such embodiments, one or more of the end caps 126 is spring-loaded in the axial direction, so that the distance between the end caps 126 can be transiently lengthened to allow the tube 122 to be installed or removed easily. The end caps 126 can fit snugly into the ends of the tube 122 so that the tube 122 is held firmly and has smooth and even rotation. Also, the tube 122 in such embodiments can be relatively rigid, as it does not have an underlying cylinder 124 to provide support. In some embodiments, at least the ends of the tube 122 or cylinder 124 are hollow for engagement with the end caps 126.

Figure 12A:
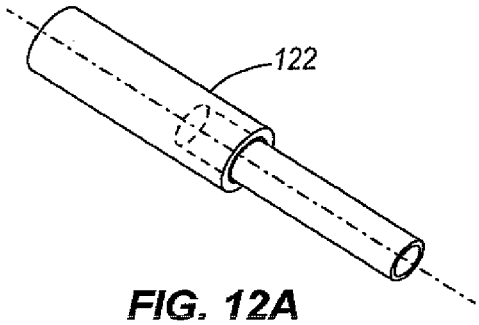
FIGS. 12A and 12B show perspective views of telescoping tubes for film removal tools according to some embodiments of the present invention.
Figure 12B:
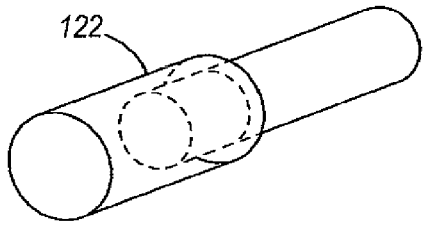

In any of the embodiments described and/or illustrated herein, the tube 122 comprises two or more parts that telescope relative to one another in order to adjust the overall length of the tube 122. In addition, the parts of the tube 122 can be spring-loaded relative to one another to allow the tube to be installed or removed more easily. A telescoping tube 122 (FIGS. 12A, 12B) can be attached to a pair of end caps 126 as above, even if the end caps 126 are not spring-loaded, since the tube 122 can be transiently compressed to fit onto the end caps 126. As an alternative to a spring-loaded tube 122 as just described, in some embodiments utilizing a cylinder 124 as described above, the cylinder 124 can similarly have telescoping portions enabling the tool 100 to be adjusted to roll up films 90 of different widths.

Figure 13:
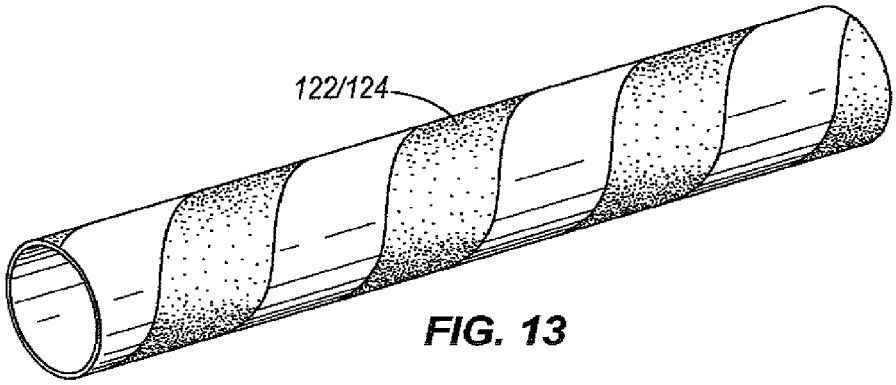
FIG. 13 shows a perspective view of a tube for film removal tools according to some embodiments of the present invention.

To begin removing a film 90 from a floor or other surface 92, a portion of the film 90 can be peeled from the surface 92 manually and attached to the tool 100 for subsequent removal. The film 90 to be removed can be attached to the tube 122 or cylinder 124 of the tool 100 in a number of ways (see FIGS. 12A, 12B, 13, 14). For example, the tube 122 or cylinder 124 can have a tacky material on an outer surface thereof, either completely covering the surface or in a pattern such as a spiral or one or more longitudinal strips (see FIG. 13). The tacky material can include an adhesive or cohesive bonding material holding the film 90 in place to facilitate peeling from the surface 92. Alternatively or in addition, the film 90 can be attached to the tube 122 or cylinder 124 by double-sided tape, a spray adhesive (e.g., a low-tack adhesive spray), a coating of cohesive film, a material having static charge, and the like.

Figure 14:
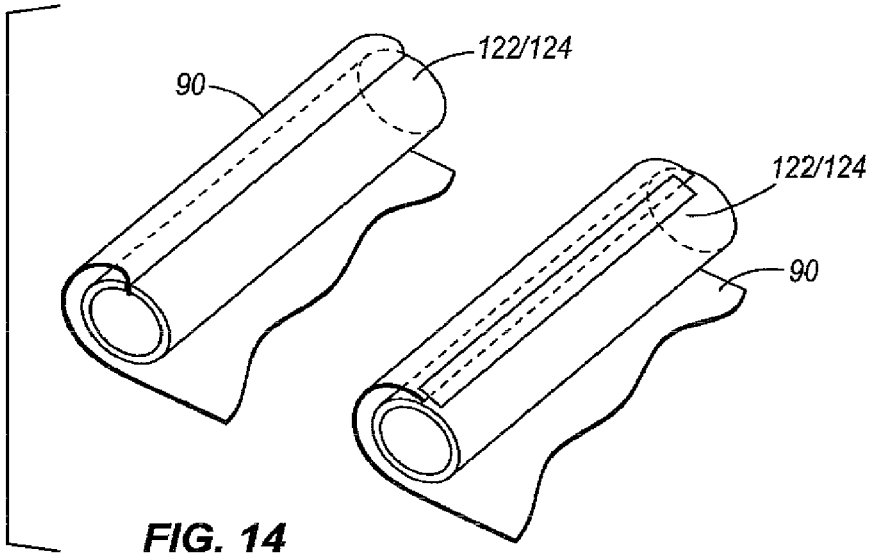
FIG. 14 shows perspective views of a tube for film removal tools according to some embodiments of the present invention, shown with different manners of attaching a film thereto.

In other embodiments, the film 90 can be taped onto the tube 122 or cylinder 124 (see FIG. 14). Alternatively or in addition, the tube 122 or cylinder 124 can have one or more slits into which the film 90 is inserted (see FIG. 14). In still other embodiments, the end of a piece of film 90 can be wrapped around the tube 122 or cylinder 124 so that the film 90 completely circles the tube 122 or cylinder 124 and wraps against itself. In such embodiments, contact between the layers of the film 90 can be sufficient (either alone or in conjunction with other manners of retaining the film 90 on the tube 122 or cylinder 124 described herein) to hold the film 90 onto the tube 122 or cylinder 124.

In some embodiments, the tool 100 has two separating devices used to separate or to assist in the separation of the film 90 before being rolled up upon the tube 122. In some embodiments, each of the separating devices comprises a blade 110 adapted to cut, perforate, score, indent, or otherwise deform the film 90 so that a portion of the film 90 can be pulled from adjacent portions of film 90 on the floor or other surface 92. The blades 110 of the tools 100 according to the various embodiments of the present invention can be made of plastic, metal, or other suitable material. With reference to the embodiment of FIGS. 1A-5, one or more of the blades 110 can, in some embodiments, be on or defined by a wheel of the tool 100, such as by a sharpened outer edge portion of a wheel. For example, each of the blades 110 on the tool 100 illustrated in FIGS. 1A-5 is defined by a sharpened edge of a wheel.

The blades 110 can be rotatably mounted in a number of locations on the tool 100. For example, in the embodiment shown in FIGS. 1A-5, the blades 110 are mounted to the frame 102 of the tool 100 near the frontward end. Although non-adjustable blades can be used, each of the blades in the illustrated embodiment is independently laterally adjustable so that the width and position of the removed strip of film 90 can be determined by setting the positions of the blades 110. In addition, in some embodiments, one or more blades 110 can be located (or adjusted to a position) laterally outboard with respect to one or more wheels of the tool 100. For example, in the illustrated embodiment, either or both brackets (each holding a respective blade 110 onto the frame 102) can be slid in an outboard direction sufficiently to position the blade 110 outside of the front wheel 106 (FIG. 1B). This permits the film 90 to be cut, scored, or perforated up to the edge of an obstruction, such as a wall. In some embodiments, this 'outboard' positioning can be used only for cutting, scoring, or perforating the film 90, while rolling of the film 90 may be performed in a separate pass.

In some embodiments, the amount of force that can be transmitted to the film 90 and surface 92 by the blades 110 can be limited by enabling the blades 110 to move with respect to the frame 102 or the portion of the tool 100 to which the blades 110 are attached. In such cases, one or more springs can be used to provide cutting force for the blades 100 (i.e., biasing the blades 100 toward the film 90 and surface 92). For example, in the illustrated embodiment of FIGS. 1A-5, downward force can be applied to both blades 110, and can be independently adjusted for each of the blades 110. This downward force can be adjusted in a number of manners to provide a deeper or shallower cutting, perforating, scoring, embossing, or other worked form by the blades 110. Downward biasing force upon the blades 110 can be adjusted by using various types of elastic elements (e.g., rubber straps) or springs. Such adjustability enables the blades 110 to operate upon the film 90 without damaging the underlying surface 92.

In the illustrated embodiment, downward force applied to each blade 110 can be adjusted using springs, where the spring tension is modulated by rotating a knob 1102 (FIG. 1B). The optimal level of spring force can depend on a number of factors such as the relative hardness of the film 90 and the surface 92, as well as the structure and hardness of the blade 110. For example, a sharper blade 110 may require less force to score, cut, or press into a film 90 than blade 110 with a dull or rounded edge.

Figure 1B:
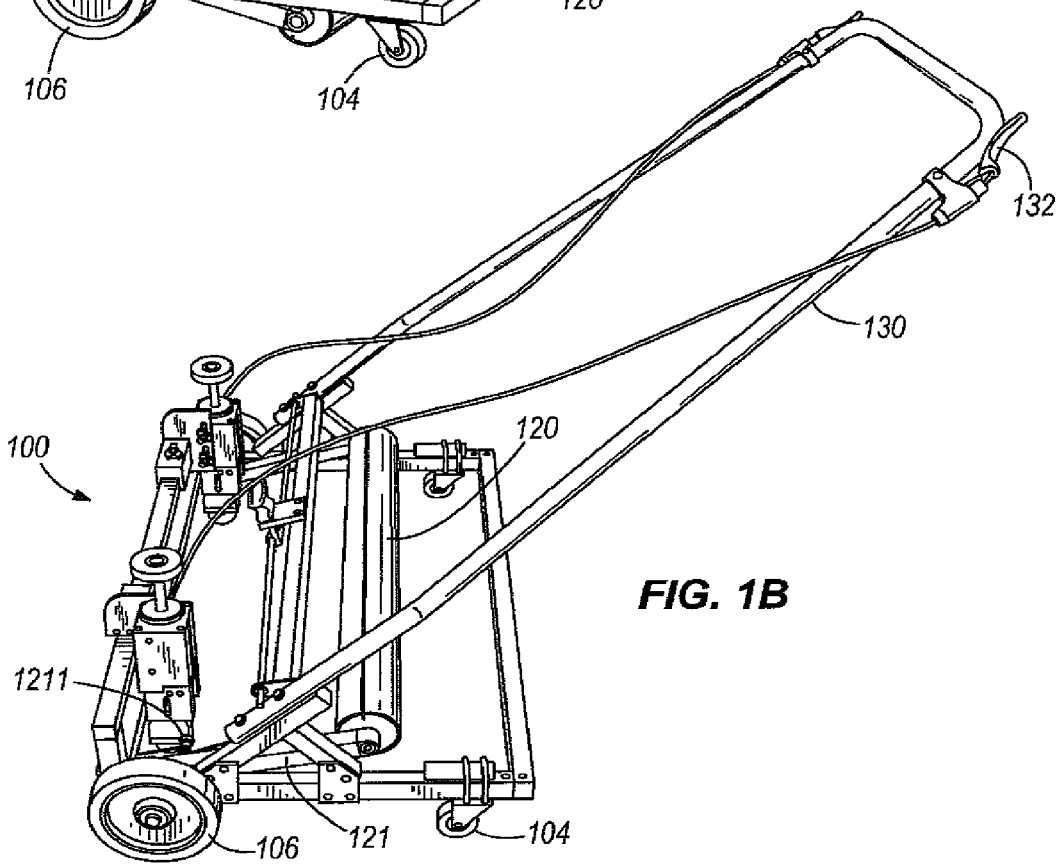
Figure 1C:
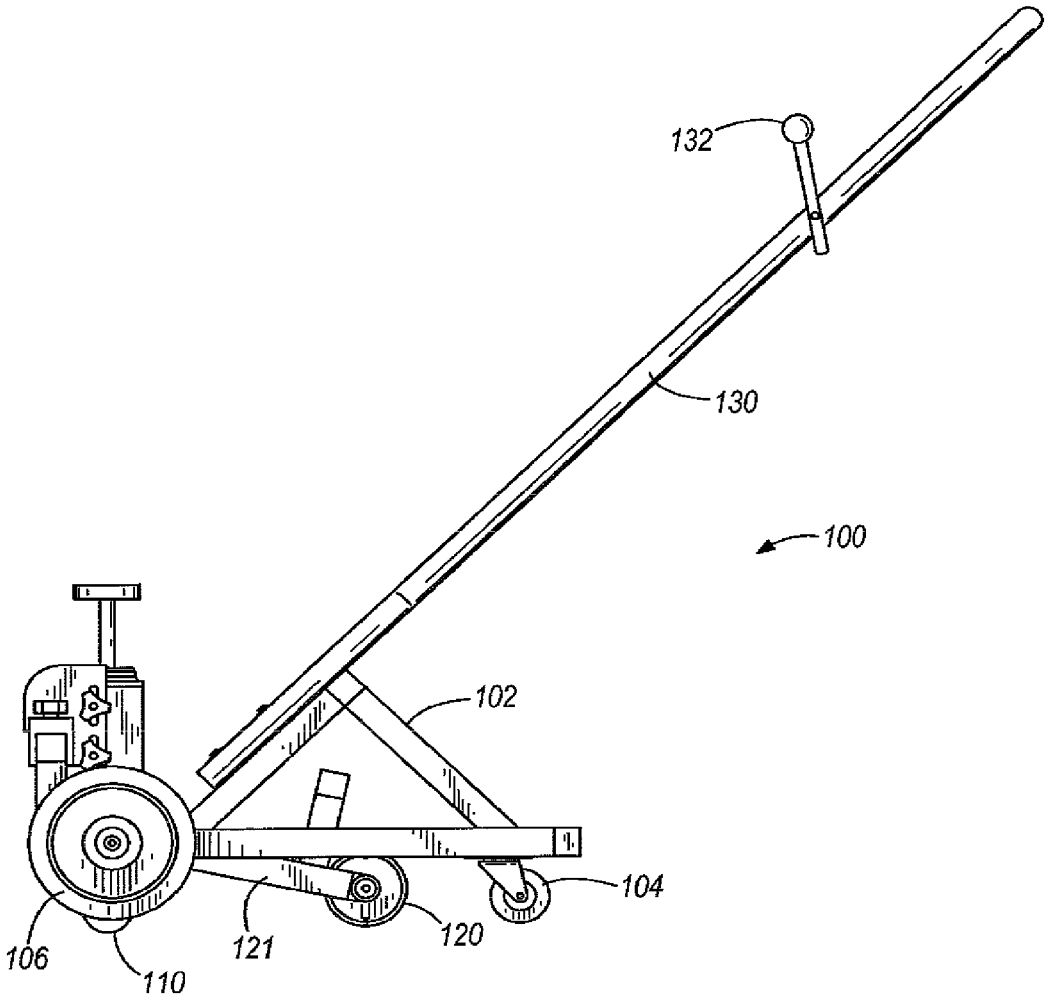
FIG. 1C is a side view of the film removal tool shown in FIG. 1A.
Figure 1D:
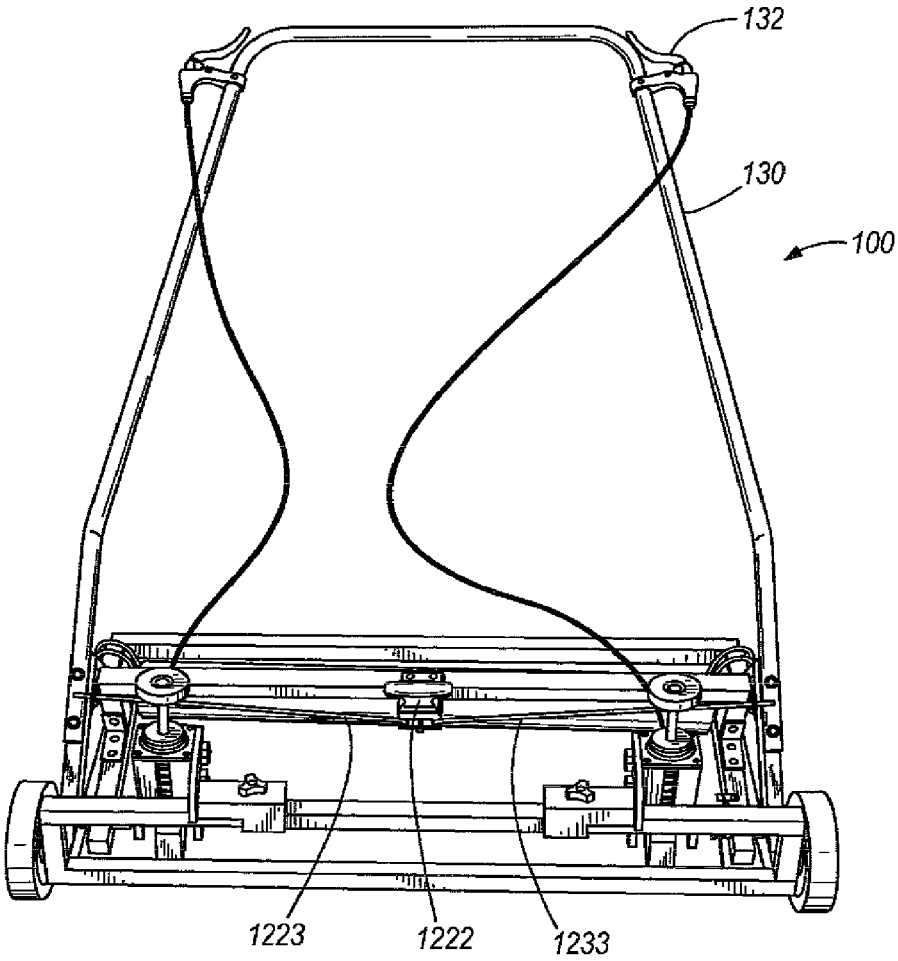
FIG. 1D is a front view of the film removal tool shown in FIG. 1B.
Figure 2A:
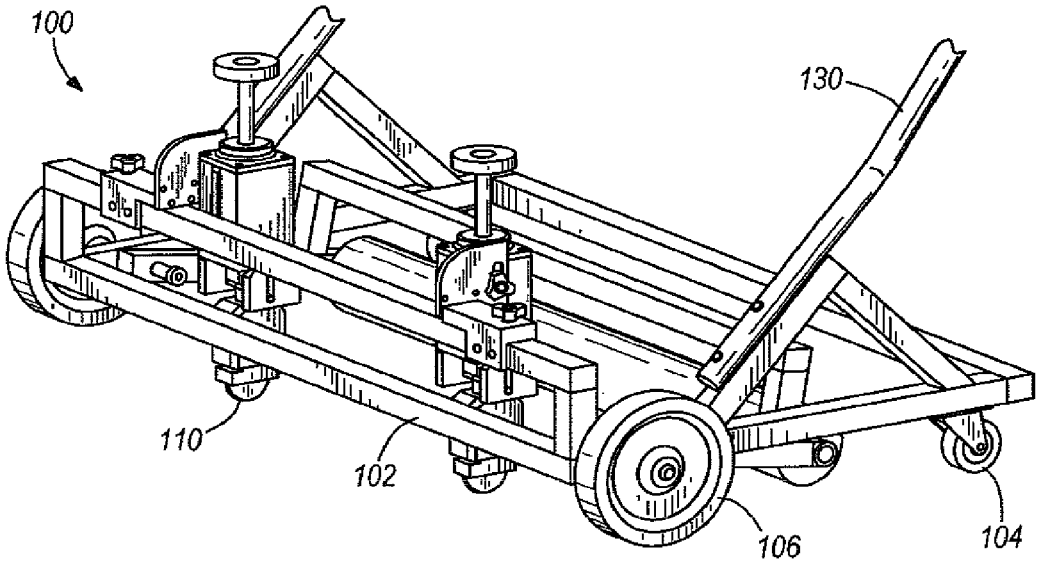
FIGS. 2A and 2C are perspective views of the lower portions of the film removal tool shown in FIGS. 1A and 1C.
Figure 2B:
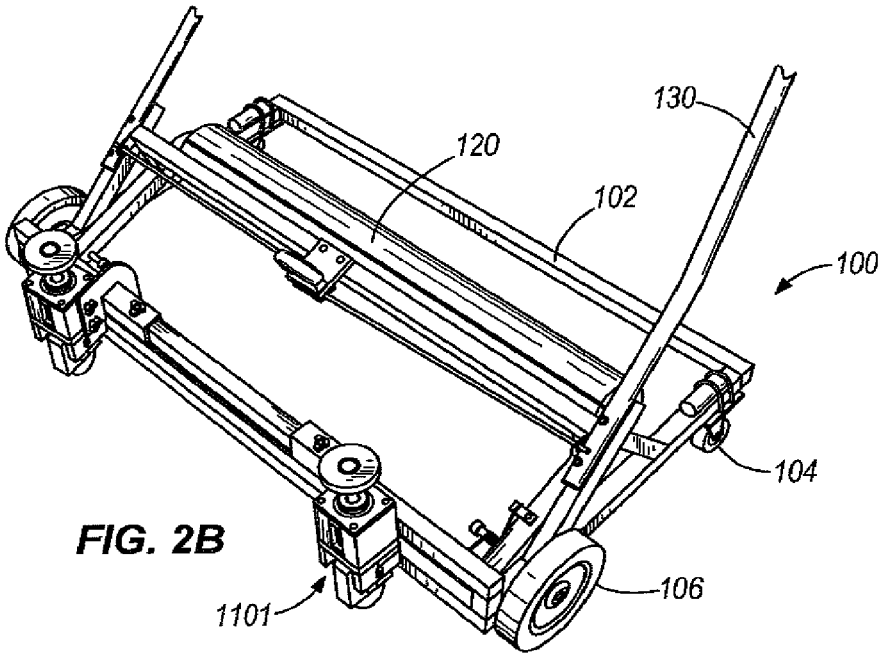
FIG. 2B is a perspective view of the lower portion of the film removal tool shown in FIG. 1B.
Figure 2C:
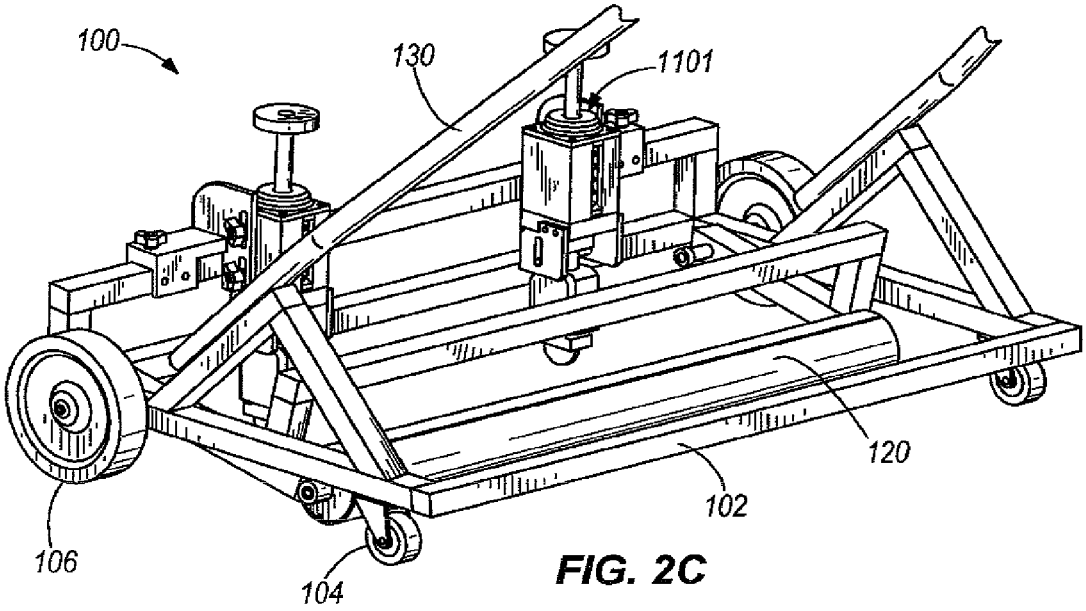
Figure 2D:
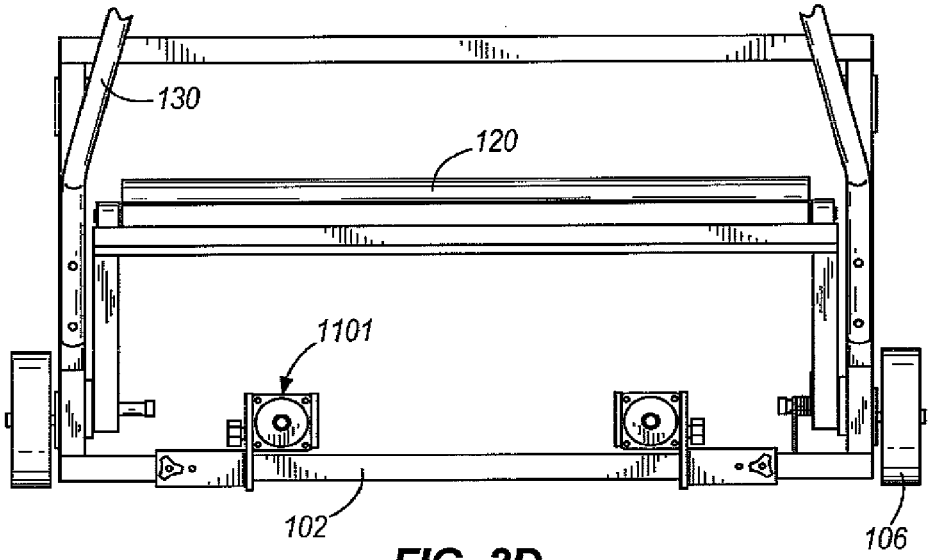
FIG. 2D is a top view of the film removal tool shown in FIGS. 1A, 1C, 2A, and 2C.
Figure 2E:
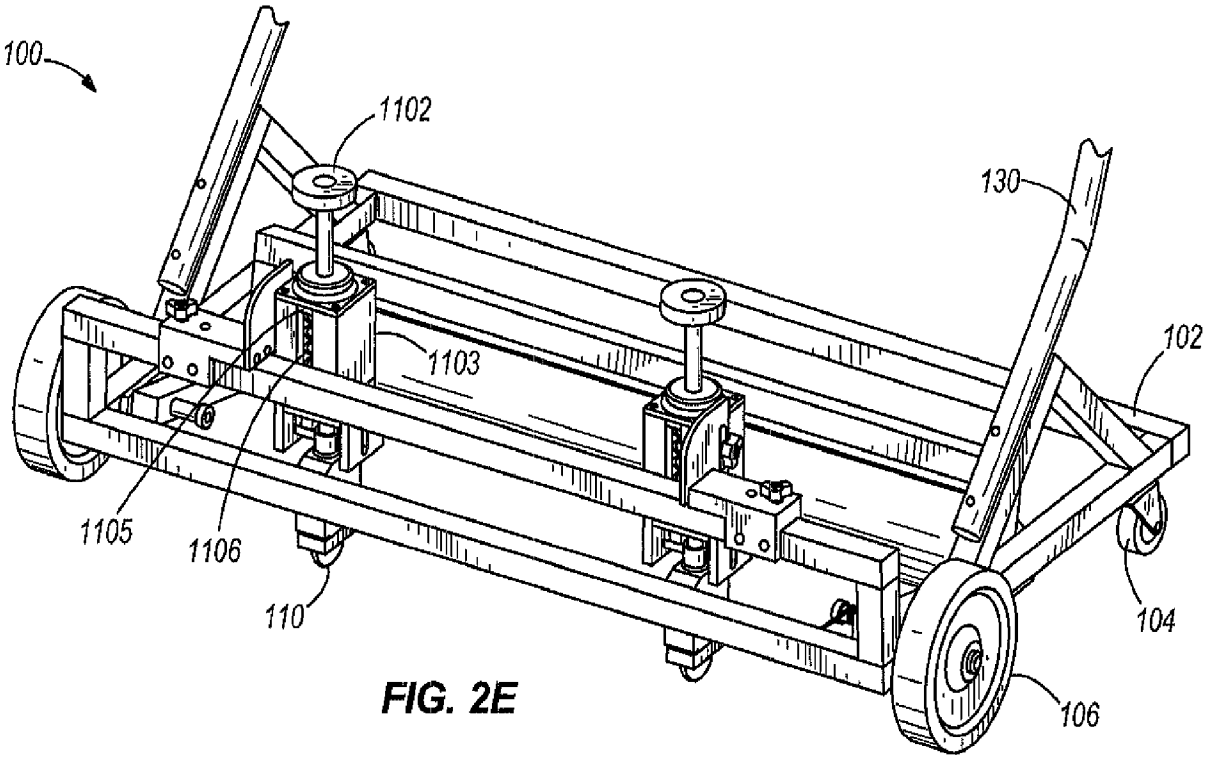
FIG. 2E is a perspective view of the lower portion of the film removal tool shown in FIGS. 1A, 1C, 2A, 2C, and 2D.

The blades 110 in the embodiment of FIGS. 1A-5 are retractable. Thus, when repositioning the tool 100 to a new location, the blades 110 can be lifted off the surface 92, e.g. to avoid damaging the blades 110 or the surface 92 or to avoid cutting portions of the film 90 that should not be cut. In addition, each blade 110 can be independently retracted, so that one blade 110 can continue to cut or score the surface 92 while the other is retracted. In the illustrated embodiments, the blades 110 are retracted by changing the position of one or more levers 132 pivotably attached to the handle 130 (FIGS. 1A, 1B). Also in the illustrated embodiments, the levers 132 are coupled to the blades 110 by a cable slidably disposed within a sleeve, sometimes referred to as a Bowden cable. However, it will be appreciated that the blades 110 can also be advanced and retracted using other devices, such as rigid rods mechanically coupling the levers 132 to the blades 110, by a stiff axial wire disposed within the Bowden cable sleeve (a "push-pull" cable), by one or more motors or solenoids attached to the blades 110, and the like. In the case of blades that are retractable and extendible by a motor, solenoid or other powered device, such devices can be controlled by one or more levers, pushbuttons, and the like, and can be powered by a battery or by a connection to an external power source (e.g., an A/C outlet).

When the levers 132 in the illustrated embodiments are moved in one direction (e.g. squeezed against the handle 130, FIG. 1A, or pulled towards the operator, FIG. 1B), the blades 110 are retracted away from the surface 110, typically in an upwards direction. To advance the blades 110 towards the surface 92, the operator can release the levers 132 so that the levers 132 return to their original positions due to the force of one or more springs as described above. In other embodiments, the blades 110 can be advanced or retracted (typically lowered or raised, respectively) by pushing or pulling the lever (e.g. where the blade 110 position is controlled by a rigid mechanical linkage or a push-pull cable) or by activating an electric motor or other powered device.

In the embodiment shown in FIGS. 1A-5, biasing force upon the blades 110 is controlled by a blade biasing assembly 1101. The illustrated assembly 1101 includes a housing 1103 to which a knob 1102 is rotatably attached via an upper shaft 1104. The upper shaft 1104 can be coupled to an upper plate 1105, which contacts a spring 1106 within the housing 1103. The spring 1106 in turn can contact a lower plate 1107 coupled to a lower shaft 1108; the lower shaft 1108 can also include a shield 1109 to protect the blade 110 from damage. The illustrated blades 110 are each rotatably attached to the lower shaft 1108 (FIGS. 3A, 3B). Thus, rotating the knob 1102 moves the upper shaft 1104 and upper plate 1105 downward, increasing force upon the spring 1106. The spring 1106 force is transferred from the lower plate 1107 to the lower shaft 1108, and to the blade 110.

In some embodiments, the lower shaft 1108 and blade 110 are stabilized against rotational movement. By way of example only, and with reference to FIGS. 3A and 3B, the lower shaft 1108 in the illustrated embodiments is stabilized against rotational movement by a rod 1108A extending laterally from both sides of the lower shaft 1108 and sliding vertically within slots on an extension 1103A of the housing 1103 (FIG. 3B). Thus, the lower shaft 1108 can move vertically, but is prevented from rotating, e.g. during adjustment. Also, this and other structures can maintain the blade 110 in a straight position during cutting.

With continued reference to the illustrated embodiments, the rod 1108A can also be used during replacement of the blade 110. If the rod 1108A is removed from the lower shaft 1108, the lower portion of the lower shaft 1108 (including the blade 110) can be removed to allow replacement of the blade 110. In some embodiments, the entire lower portion of the lower shaft 1108 is replaced, while in other embodiments, the blade 110 can be detached from the lower portion of the lower shaft 1108 for replacement with a new blade 110. Each blade 110 can be made from a number of materials, suitably materials with a greater hardness than the film 90 that is being removed. For example, the blades 110 can comprise metal, plastic, ceramic, or other materials, and can have a number of profiles (e.g., thick with a tapered edge sharpened or rounded at the end, or relatively thin (e.g. like a razor blade) with a sharpened or rounded outer edge).

Figure 3A:
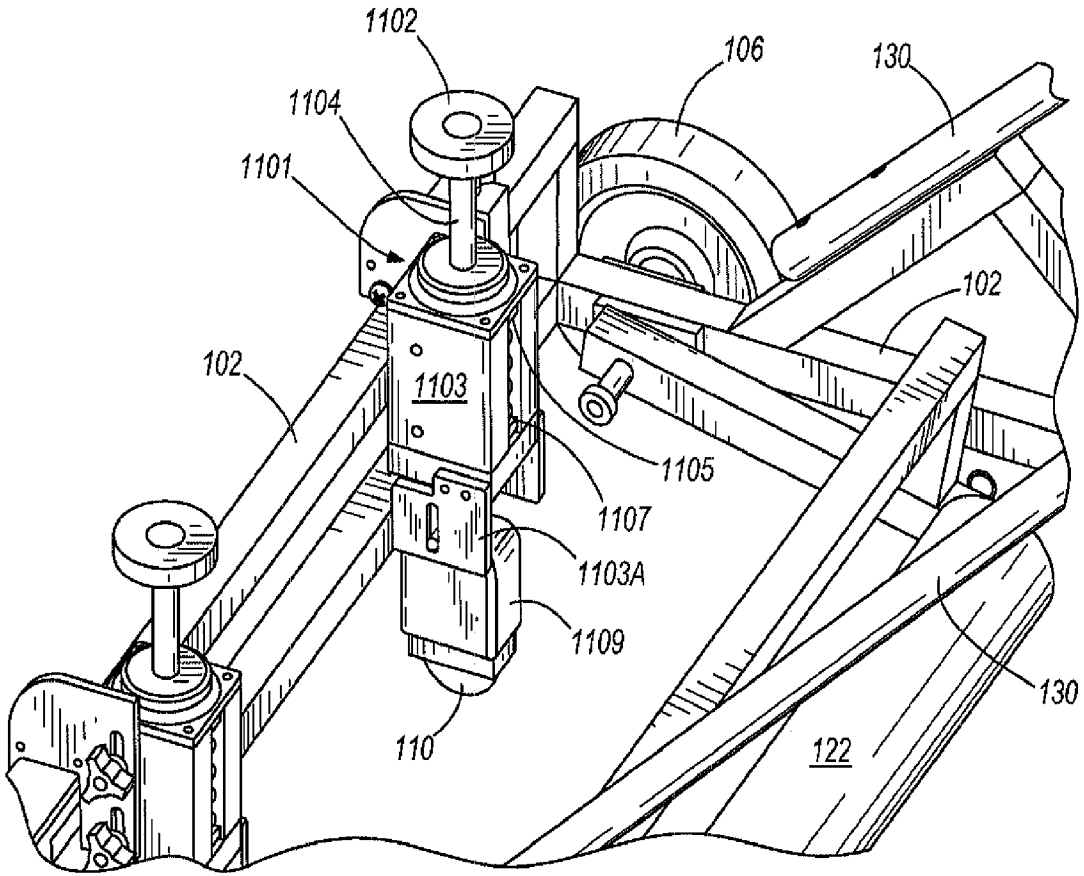
FIGS. 3A and 3B are perspective views of cutters used in the film removal tool shown in FIGS. 1A, 1C, 2A, 2C-2E.
Figure 3B:
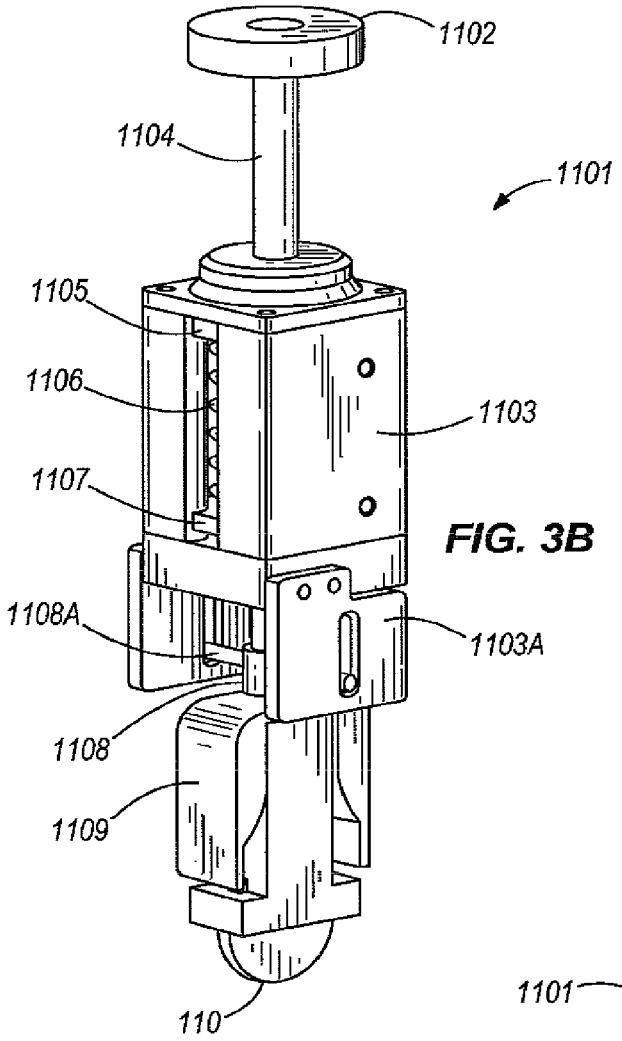
Figure 3C:
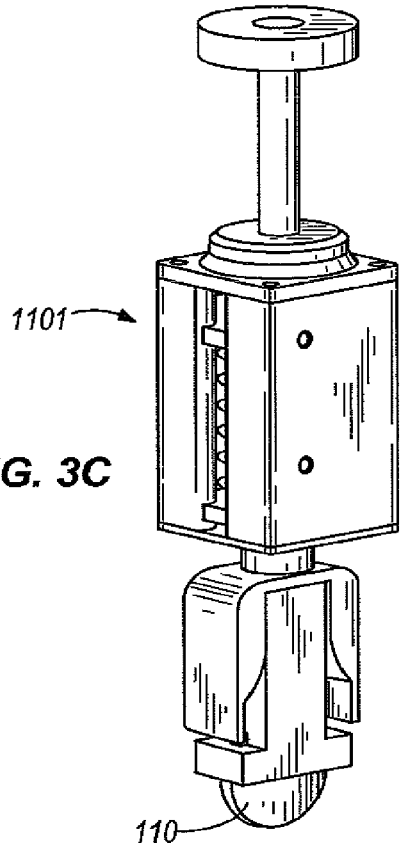
FIG. 3C is a perspective view of a cutter used in the film removal tool shown in FIGS. 1B, 1D, and 2B.
Figure 4:
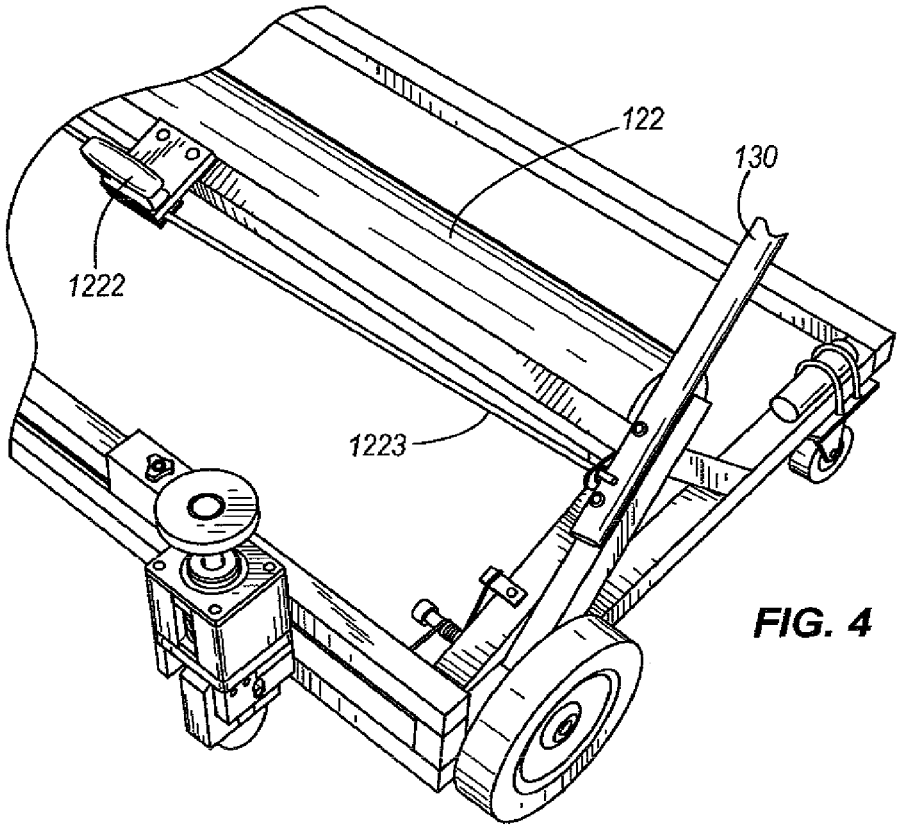
FIG. 4 is a detail view of the mechanism for maintaining a film removal tool roller in an elevated position for the film removal tool shown in FIGS. 1B, 1D, 2B, and 3C.
Figure 5:
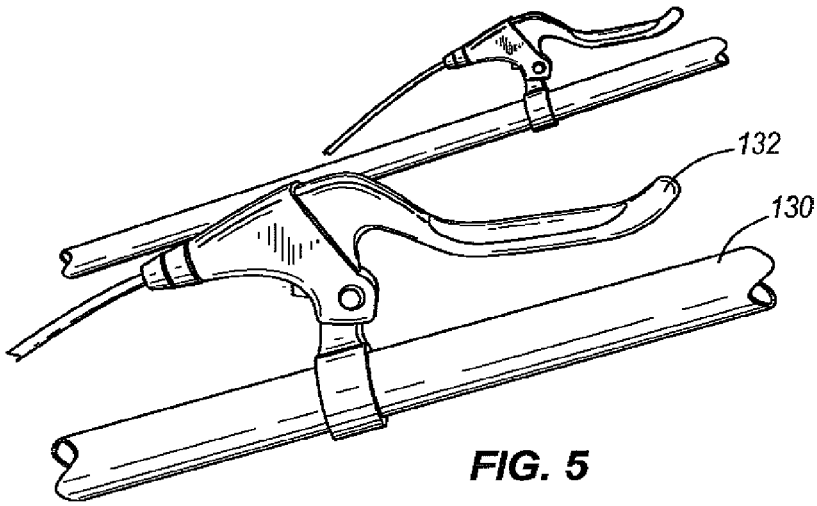
FIG. 5 is a detail view of a pair of levers attached to the handle of the film removal tool shown in FIGS. 1B, 1D, 2B, 3C, and 4.

In some embodiments, the height of the housing 1103 is adjustable relative to the frame 102, e.g. using hand-tightened screws in a slot (see FIG. 3A). Suitably, the height of the housing 1103 can be adjusted so that when the blade 110 contacts the surface 92, the lower plate 1107 is not touching the bottom of the housing 1103. Therefore, the tension of the spring 1106 serves to press the blade 110 against the surface 92.

The sleeve of the cable that connects the levers 132 to the blades 110 in the illustrated embodiments is coupled to the housing 1103 of the blade tension assembly 1101. The cable inside the sleeve runs through the housing 1103, the upper plate 1105, and the spring 1106, and connects to the lower plate 1107. When the lever 132 is moved (e.g. by squeezing against the handle 130 or pulling towards the operator), the wire slides within the sleeve, and effectively shortens at the end near the blade 110. The force caused by the effective shortening of the wire pulls the lower plate 1107 upward, which in turn lifts the lower shaft 1108 and the blade 110 away from the surface 92. When the levers 132 are released, force on the wire is released or reduced, and the wire is effectively lengthened at the end of the cable near the blade 110. The lower plate 1107, lower shaft 1108, and blade 110 then return to their original positions, and the force upon the blade 110 generated by the spring 1106 is restored to its original level.

In some embodiments, the blades 110 are mounted on a pivoting arm at the front of the tool 100, such that downward pivoting of the arm presses the blades 110 against the surface 92. The downward pivoting of the arm can be provided by gravity alone, or can be supplemented by a biasing force, e.g. from a spring.

Figure 15:
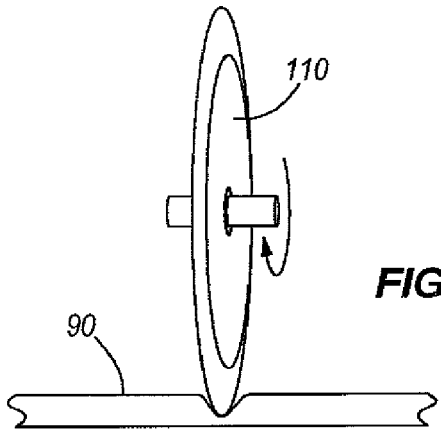
Figure 16:
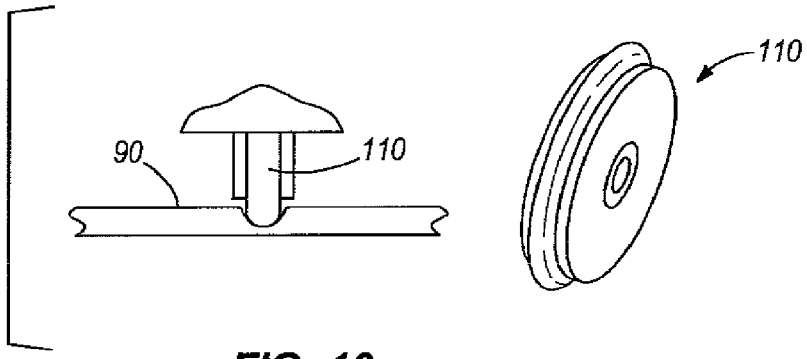

As described above, the tool 100 has one or more blades 110 to separate or assist in separating film 90 to be wound upon the tube 122 or cylinder 124. As also described above, the blades 110 in the illustrated embodiment of FIGS. 1A-5 are rotatably-mounted, wheel-shaped cutters in which the outer circumference is a sharp edge. A small, sharpened carbide wheel, such as the type used in glass cutters, can also be used as the blades (see FIG. 8). It is also possible for the blades 110 to have other, non-sharpened profiles. For example, in those embodiments where the blades 110 are wheel-shaped cutters, the blades can be slightly rounded at their outer edges, such that the outer edges makes an indentation in the film 90 to create a weakened area along which tearing and separation of the film 90 can occur (see FIG. 15). In other embodiments, the blades 110 each comprise a flat wheel having a rounded bead in the center, wherein the bead produces a compressed line in the film (see FIG. 16).

Figure 17:
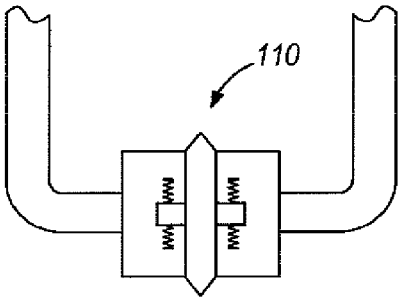

In some embodiments, one or more of the blades 110 are located in a wheel (FIG. 17) with a flat outer circumference, and define a central ridge of the wheel. In such embodiments, the blade 110 is maintained under spring tension independent of the wheel. Thus, the flat portion of the wheel rolls along the surface 92 while the spring-loaded blade 110 in the center of the wheel presses against the film 90 to make an indentation or cut along which the film 90 will tear when pulled up. The spring tension can be set so that the blade 110 presses partly or completely through the film 90, yet does not damage any underlying layers of the surface 92.

Figure 18:
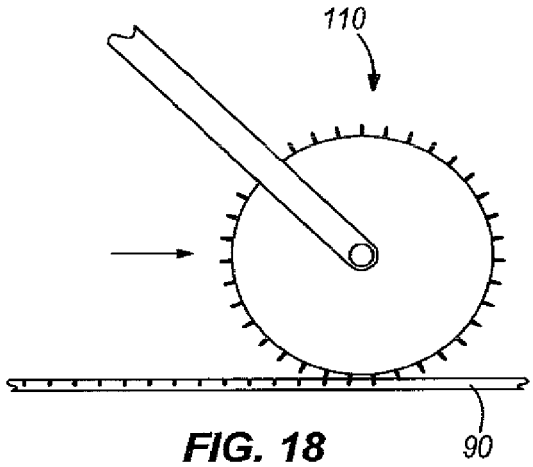
Figure 19:
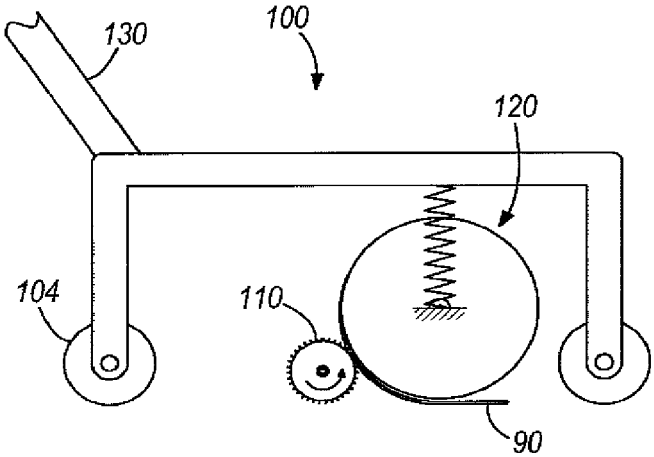

In other embodiments, one or more of the blades 110 can have an outer edge that perforates the film 90 rather than completely cutting it. In such embodiments, the outer edge of the blade 110 can comprise a series of points, such as pins (FIGS. 18, 19), or discontinuous edges, such as on a sprocket (FIG. 20). In some embodiments, a plurality of scoring blades 110 are located in front of the roller 120 to help score the film 90 being removed in multiple locations, and also to reduce surface tension so that the film 90 can be peeled off the surface 92 more effectively (FIG. 21).

Figure 23:
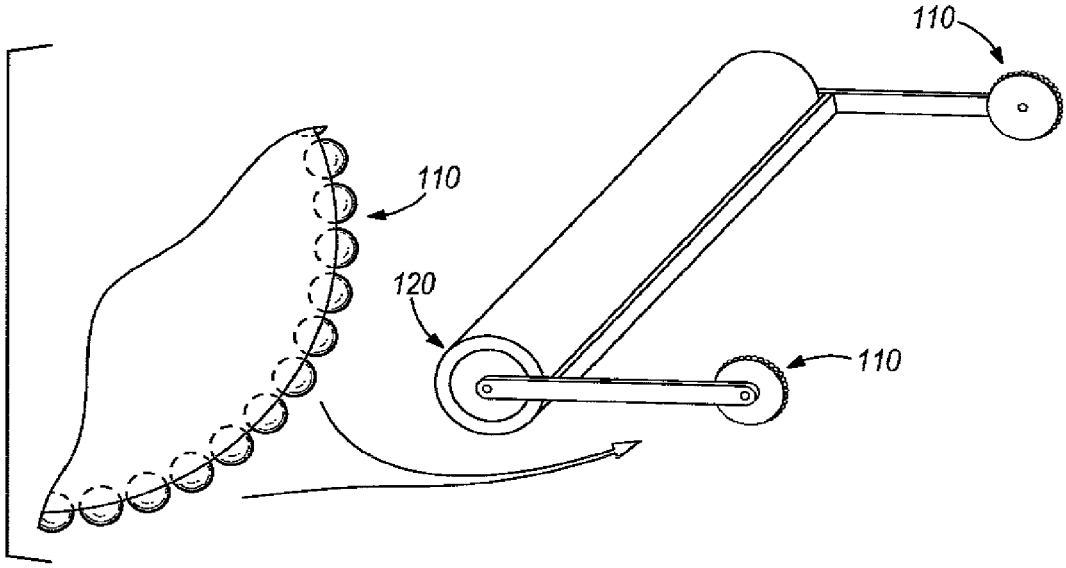

In still other embodiments, one or more of the blades 110 can be defined by one or more ball bearings, such as a ball bearing held against the surface 92 at the end of a rod (FIG. 22), or a wheel having a plurality of ball bearings attached at an outer edge thereof (FIG. 23). One or more of the ball bearings can be spring-loaded in order to maintain continuous contact with the surface 92 and to also adjust how firmly the ball bearing(s) press against the film 90.

Figure 24:
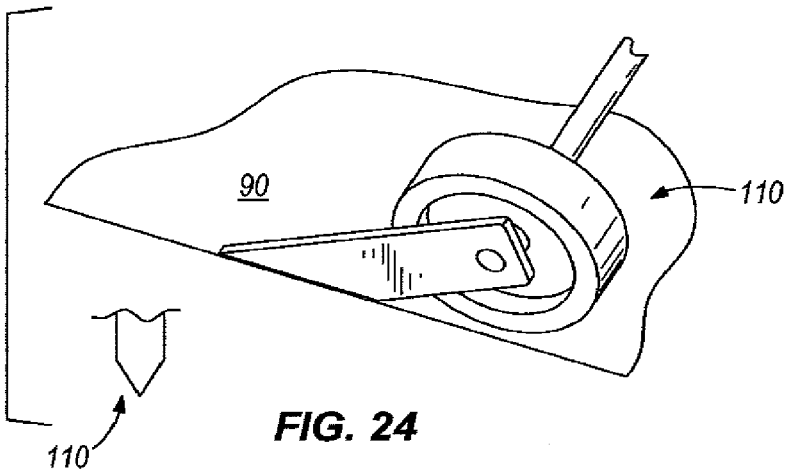
Figure 25:
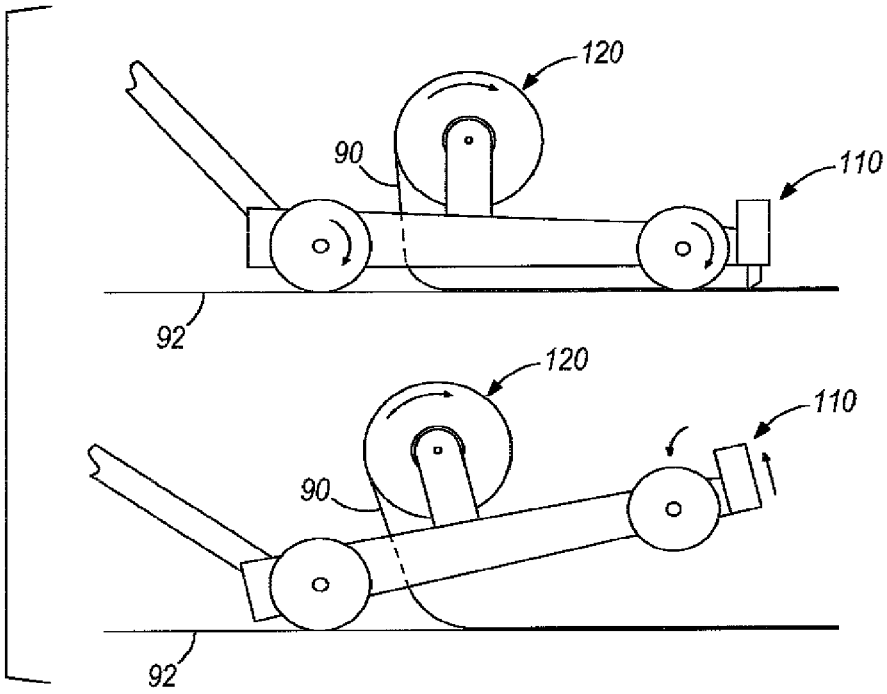
FIG. 25 shows side views of a film removal tool according to another embodiment of the present invention, shown in different states of operation.
Figure 26:
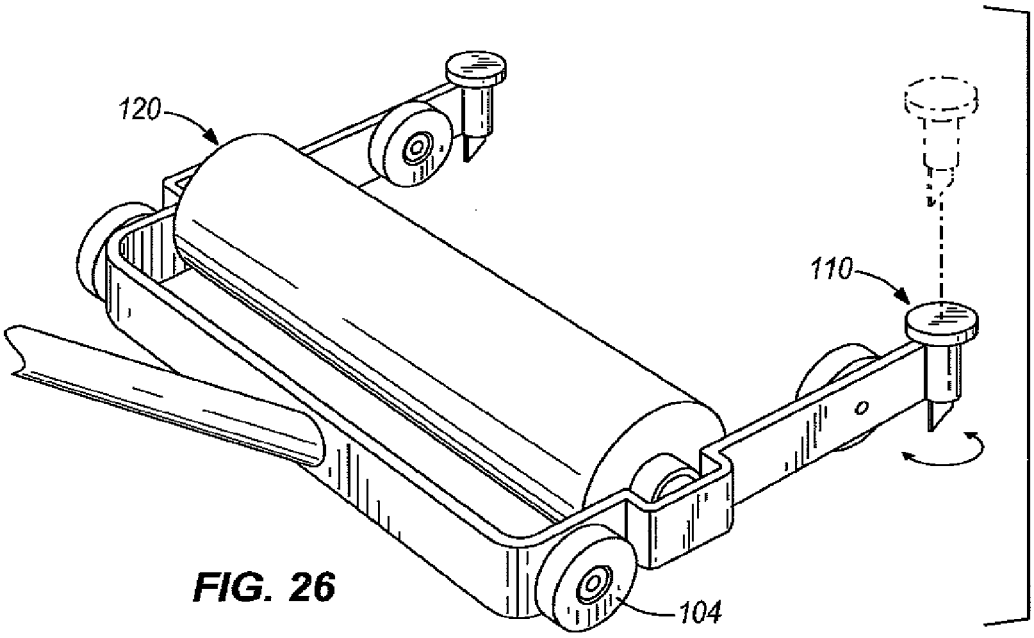
FIG. 26 shows a perspective view of a film removal tool according to another embodiment of the present invention.

In some embodiments, one or more of the blades 110 is a non-rotating, straight cutting edge moved across the surface 92 in order to cut or score the film 90 to be removed (FIG. 24). The cutting edge can be retracted when the front of the tool 100 is lifted off the ground (FIG. 25), and/or can be pivotable about a vertical axis (i.e. an axis normal to the surface 92), to facilitate turning of the tool 100. Also, in some embodiments, the cutting edge can be spring-loaded so that it remains in continual contact with uneven surfaces (FIG. 26).

Figure 27A:
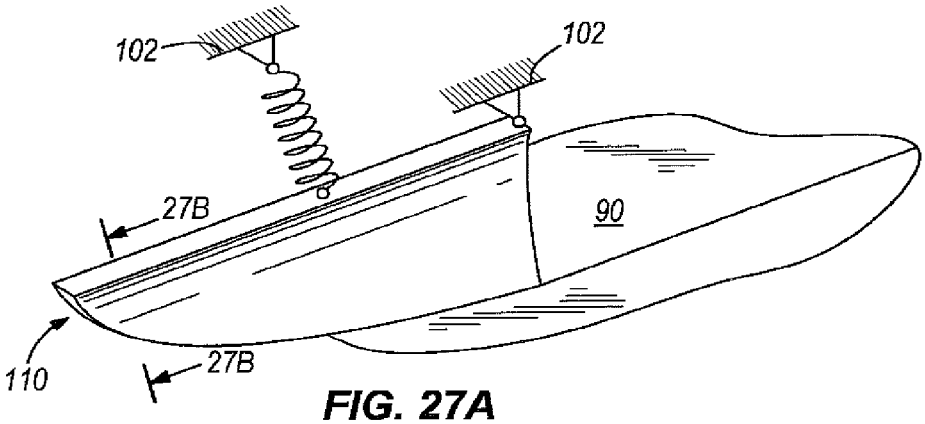
Figure 27B:
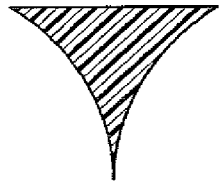

In some embodiments, one or more of the blades 110 is curved or tapered, and in some cases can have a biconcave cross-sectional shape (FIGS. 27A, 27B). Also, in some embodiments, one or more of the blades 110 can be attached to the frame 102 of the tool 100 at two points, such as one point near the rear of the blade defining a pivoting attachment point, and another point forward of the first point. Such blades 110 can be spring-loaded (FIG. 27A), wherein spring force pushes each blade 110 against the surface 92. During use, each blade 110 gradually rotates towards the sharper (unused) edge as the part of the blade 110 is in contact with the surface 92 wears down. Thus, a sharp portion of the blade 110 is continually brought into contact with the surface 92.

Figure 28:
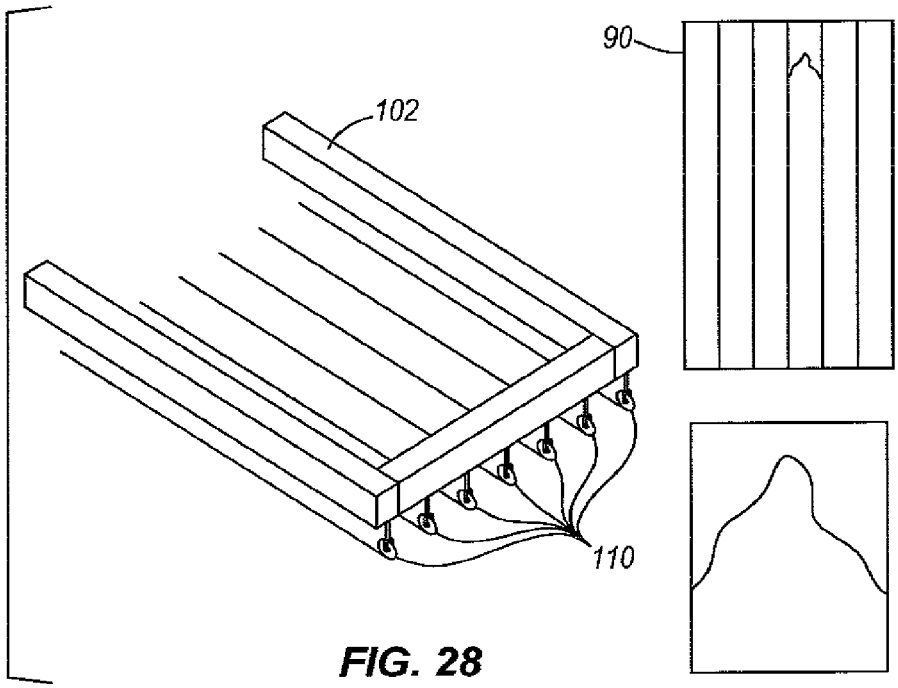
FIG. 28 shows a detail perspective view of a film removal tool according to another embodiment of the present invention.

In some embodiments, the tool 100 comprises a plurality of blades 110 attached to the frame 102 so that the film 90 is cut or scored into multiple strips prior to removal (FIGS. 21, 28). The strips can be narrower than the width of the cylinder 124 or tube 122 onto which the film 90 is collected.

Figure 7:
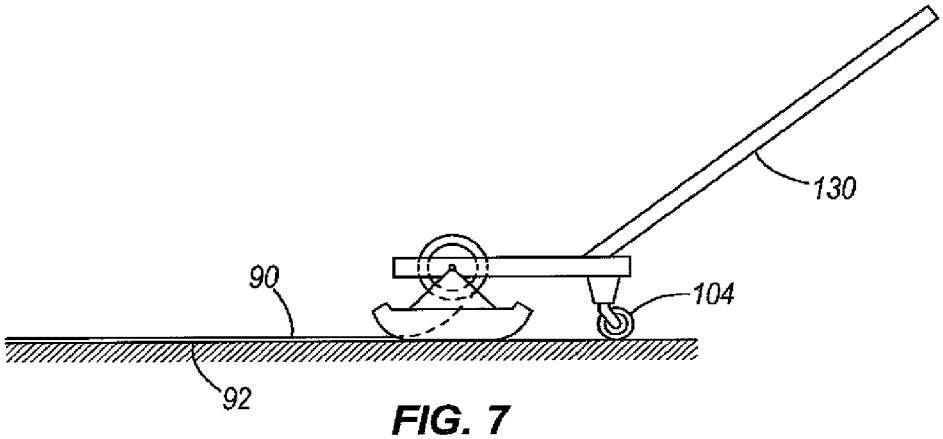
FIG. 7 shows a film removal tool according to another embodiment of the present invention.
Figure 29:
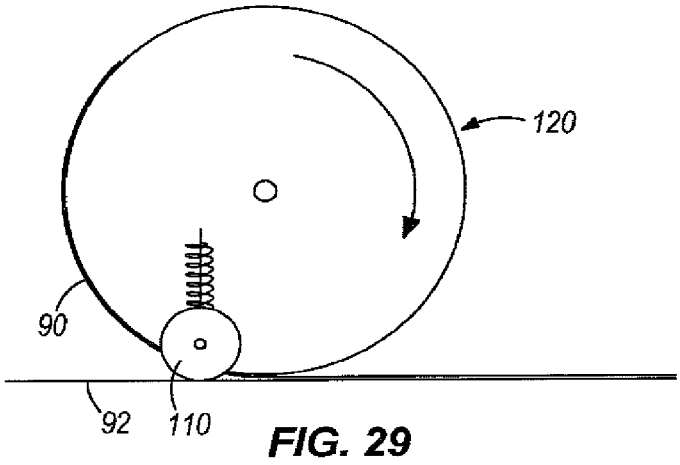
FIG. 29 shows a detail side view of a film removal tool according to another embodiment of the present invention.

It should be noted that the blades 110 in the various embodiments of the present invention 110 do not necessarily cut, score, or perforate the film 90, but can instead hold down the portion of the film 90 adjacent to where the roller 120 lifts the film 90 from the surface 92, thereby allowing the film 90 to tear cleanly without pulling up nearby film 90. This function of the blades 110 can be particularly desirable where only a portion of the film 90 is removed and replaced, such as in a high-traffic area of a floor. In such embodiments, the blades 110 can each be a wheel (not necessarily sharpened) touching the surface 92 near the roller 120 to hold down a portion of the film 90 while a nearby section of film 90 is pulled up. Alternatively, a sharpened wheel blade 110 can be located just behind the roller 120 to cut the film 90 as it is being lifted from the surface 92 (FIG. 29). In other embodiments, the blades 110 can each be a non-rotating surface adjacent the roller 120, such as a sled-type runner or other object that runs along the surface 92 without rotating, and which also serves to hold one portion of film 90 against the surface 92 while another, nearby part of the film 90 is removed (FIG. 7).

Figure 30:
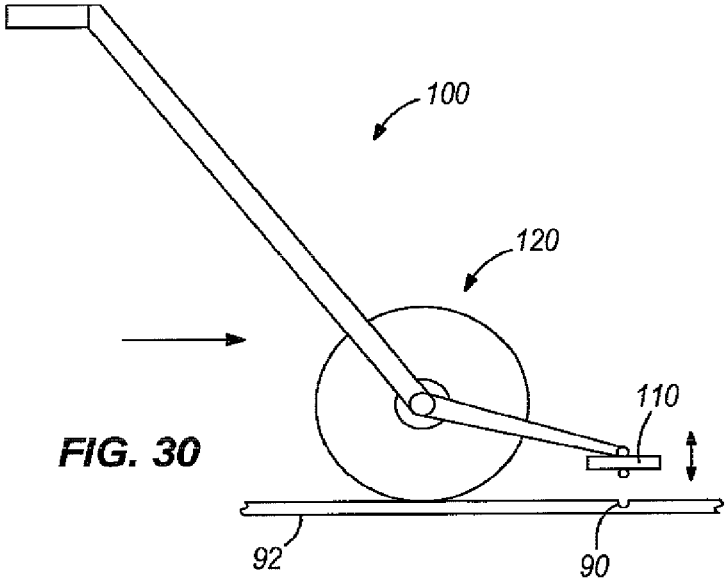
FIG. 30 shows a side view of a film removal tool according to another embodiment of the present invention.
Figure 31:
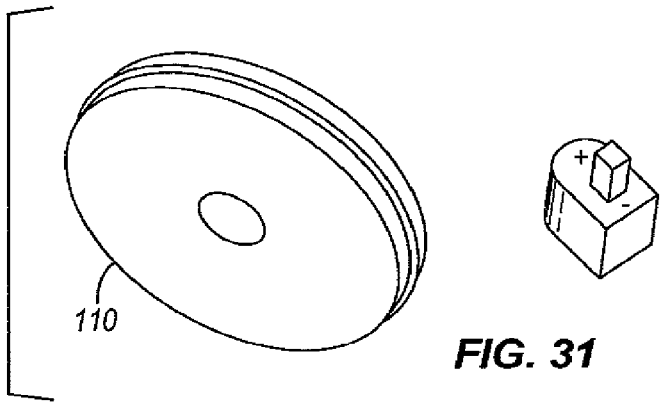

In some embodiments, one or more of the blades 110 is a heated implement such as a straight edge, wheel, or rod. The heated edge of such blades 110 produces a slight or complete melting of the film 90 to be removed so as to promote tearing and separation at the point of contact of the blade 110 (FIG. 30). For example, the blade 110 illustrated in FIG. 31 is on a wheel, and takes the form of a wire wrapped around the circumference of the wheel. A current is run through the wire to heat the wire, and can be supplied by a number of mechanisms, such as a disposable or rechargeable battery mounted on the tool 100 (e.g., on the wheel). However, in some embodiments, the wire can be used without heating in order to produce an indentation in the film 90 along which the film 90 can tear and separate.

Some embodiments of the tool 100 have no blades 110. Instead, the film 90 gathered on the roller 120 simply tears away from the film 90 still attached to the surface 92. Satisfactory film removal results in such cases can depend at least in part upon a number of factors, such as the tensile strength of the film 90, how strongly the film 90 is attached to the surface 92, and how clean the separated edge must be for a particular application. For example, if the film 90 in an entire room is being removed, it may not matter whether the film 90 cleanly separates from other film 90 remaining on the floor. Alternatively, if only a portion of the film 90 is going to be removed for subsequent replacement, such as in high-traffic areas of a room, it may be more desirable to have the removed film 90 cut cleanly along one or more edges and to keep the non-removed portions of the film 90 firmly attached to the surface 92.

Figure 32:
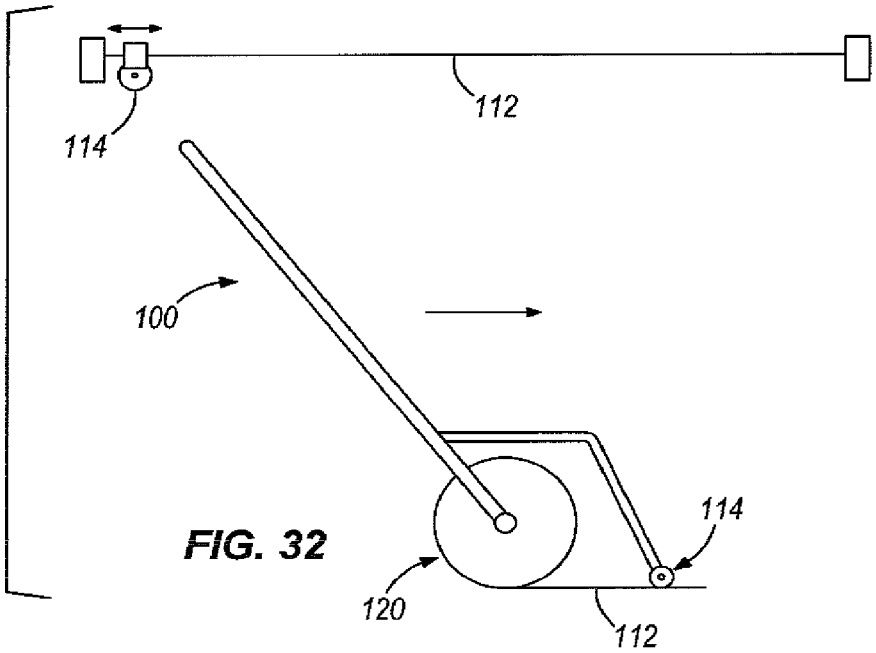
FIG. 32 shows a side view and a detail from view of a film removal tool according to another embodiment of the present invention.

In some embodiments, the film 90 may be pre-taped along one or more edges at which separation and removal of the film 90 is desired, with tape 112 helping to define an edge along which tearing and separation of the film 90 occurs. Pre-taping of the film 90 can be combined with any of the above-described embodiments of the blades 110 according to the present invention, although pre-taping can be particularly useful when separating devices 110 are omitted. Tape 112 can be applied manually to define an area inside of which the film 90 is removed. Alternatively, the tool 100 can include a dispenser 114 that applies tape 112 ahead of the roller 120. The tape 112 can then be removed along with the film 90. In these and other cases, double-sided tape 112 can be used, as the exposed adhesive can help pull up the edges of the film 90 as the film 90 is rolled (FIG. 32). Alternatively, the tape 112 can be applied by the tool 100 so that the tape 112 is not taken up along with the removed film 90, but instead is applied outside the area where the film 90 is being removed and remains on the surface 92 with the non-removed film 90.

Figure 33:
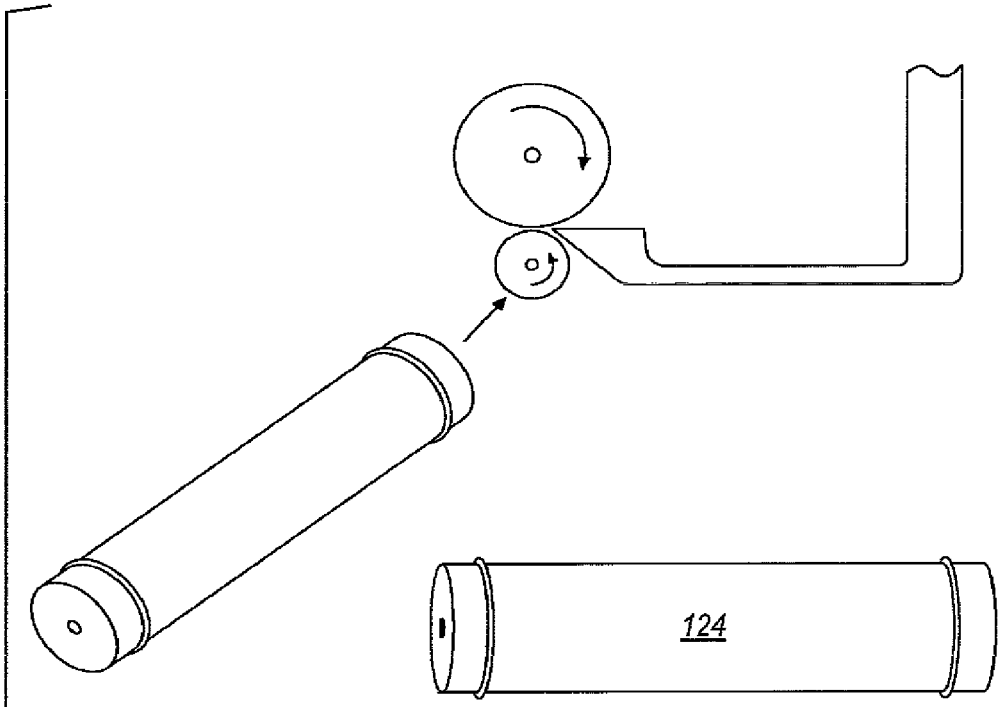
FIGS. 33-36 show rollers and related elements of a film removal tool according to another embodiment of the present invention.
Figure 34:
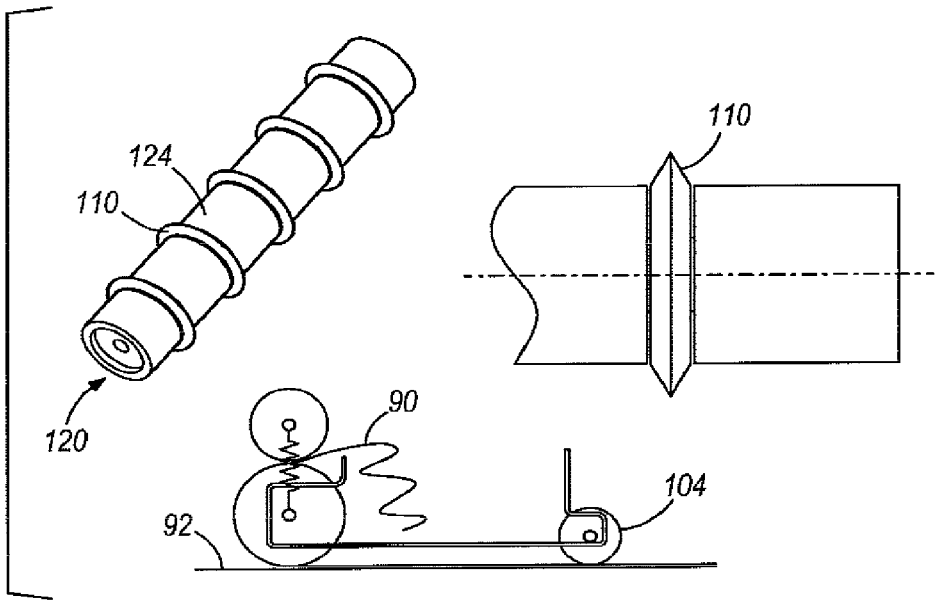
Figure 35:
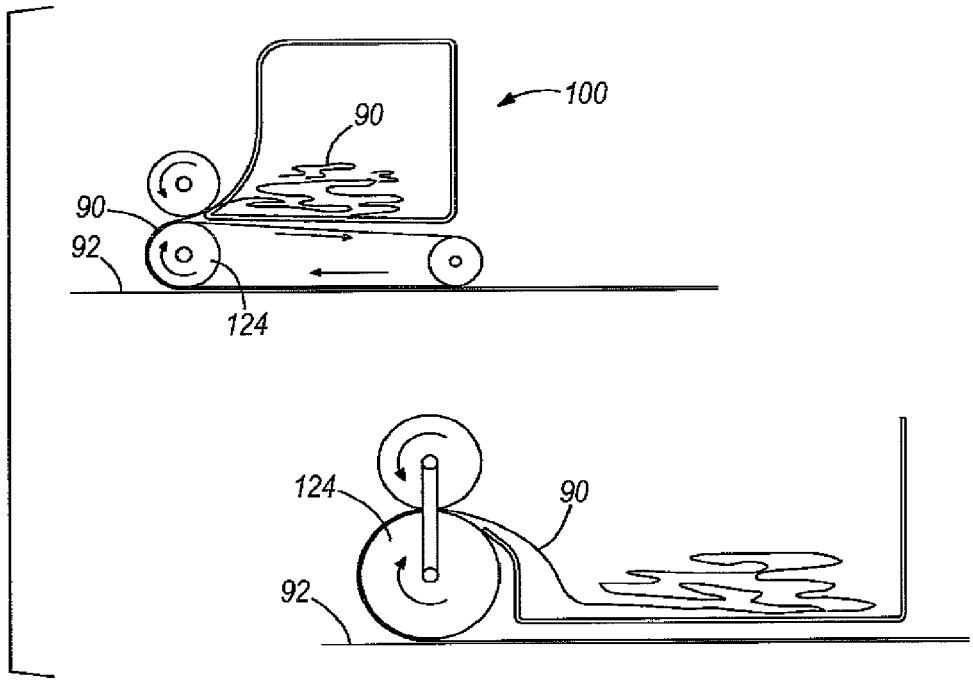

Although film 90 can be rolled upon a roller 120 for efficient film removal and disposal, the film 90 in other embodiments is not wound upon the roller 120. For example, in some embodiments of the present invention, the removed film 90 is directed to a collecting receptacle during removal (see FIGS. 33, 34, 35). In such embodiments, the roller 120 can comprise a cylinder 124 with a tacky outer face that removes the film 90 from the surface 92 due to adhesion of the film 90 to the roller mechanism 120. The tool 100 in such embodiments can also include a scraper that separates the removed film 90 from the roller 120, depositing the removed film 90 into a collecting receptacle on the tool 100 and cleaning the cylinder 124 while still leaving its tacky outer face exposed for further film 90 collection (see FIG. 35). In these and other embodiments, the roller 120 comprises a plurality of blades spaced from one another which separate the removed film 90 into one or more strips as the film 90 is removed from the surface 92 (FIGS. 33, 34). These blades can produce indentations in the film 90 by pressing against the surface 92 to which the film 90 is adhered, and also by squeezing the collected film 90 between the ridges and an adjacent roller (FIGS. 33, 34). The adjacent roller can be held tightly against the blades under spring force from one or more biasing elements (FIG. 34).

Figure 36:
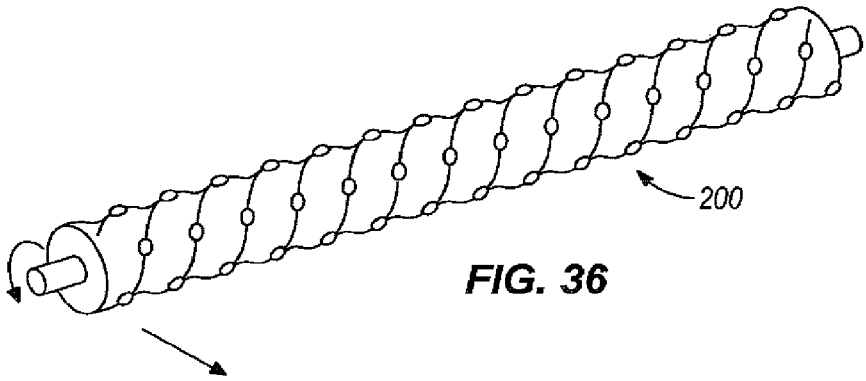
Figure 37:
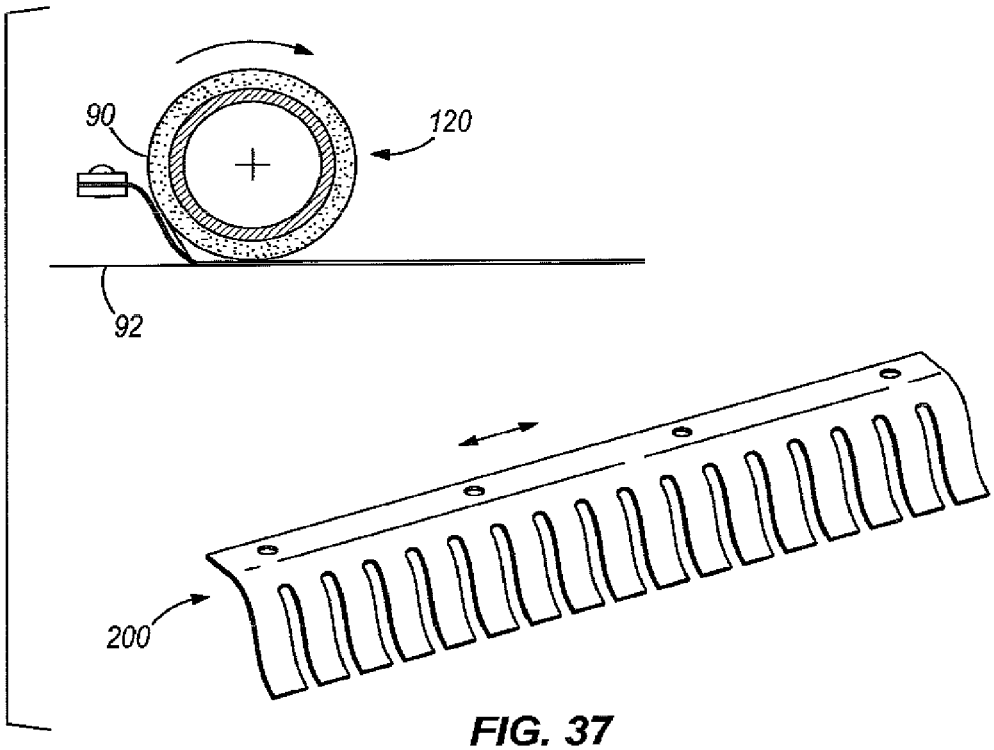
FIGS. 37-42 show peeling devices for a film removal tool according to some embodiments of the present invention.
Figure 38:
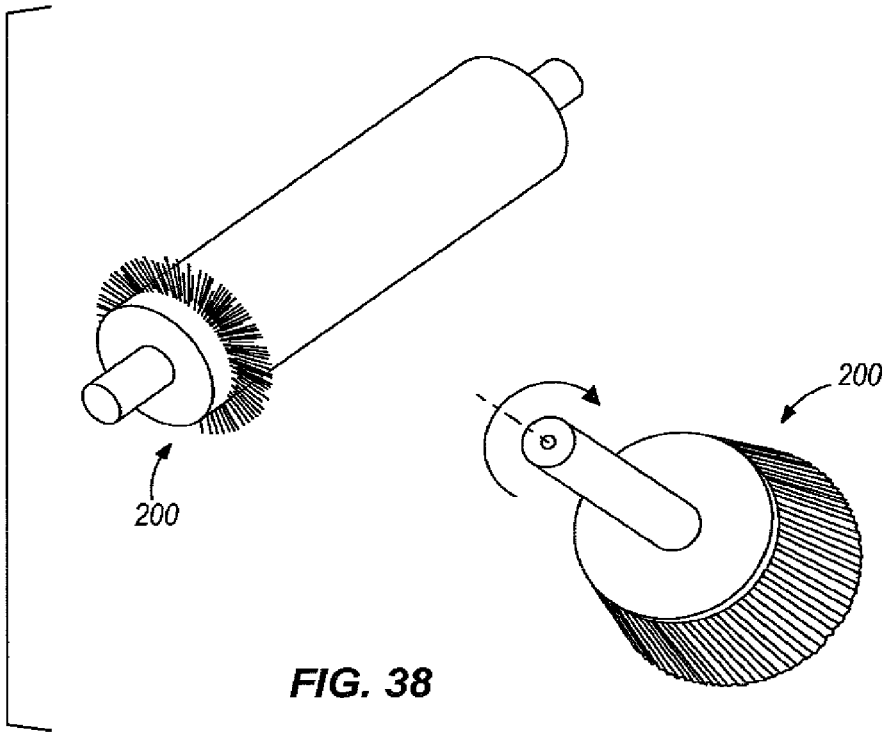
Figure 39:
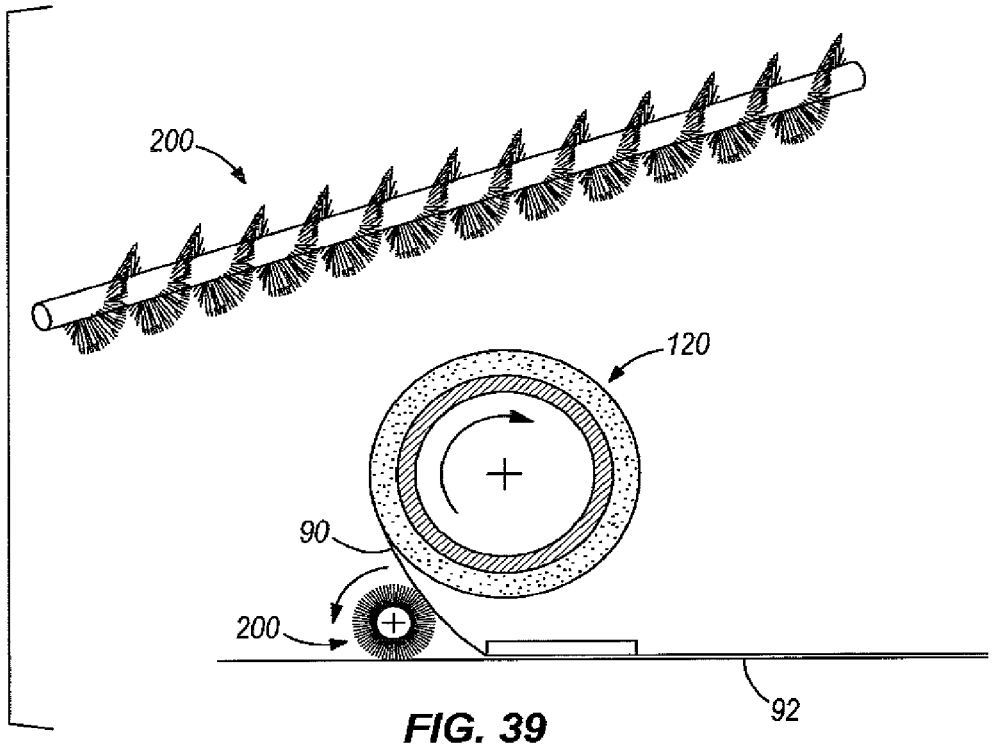
Figure 40:
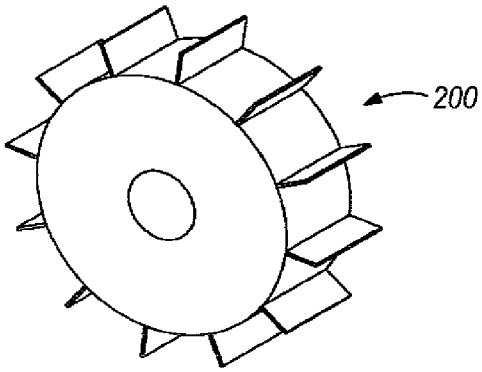
Figure 41:
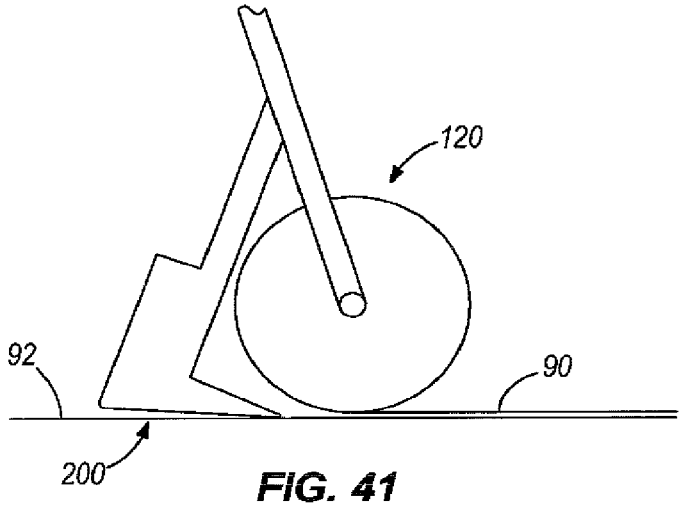
Figure 42:
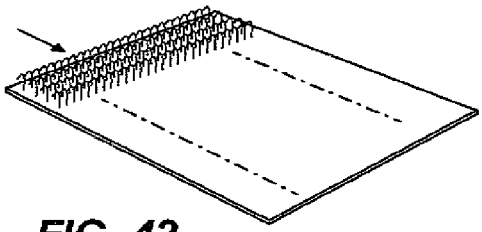

In some cases, the film 90 may not cleanly separate as it is removed from the surface 92 by the tool 100, resulting in non-removed sections of film 92. Therefore, in some embodiments the tool 100 further comprises a secondary peeling device 200 to lift off such portions not initially collected by the roller 120. For example, in some embodiments, the secondary peeling device 200 comprises a driven, counter-rotating roller having a number of resilient, tacky nubs thereon. The counter-rotating roller rotates in a direction opposite the roller 120, and can be held firmly against the surface 92, such that the resilient, tacky nubs separate from the surface any portions of the film 90 not pulled up with the main portion of the film 90 by the roller 120 (FIG. 36). Alternatively or in addition, the secondary peeling device 200 can comprise one or more combs attached to the tool 100 and positioned to scrape the surface 92 immediately behind the roller 120. In these and other devices, the secondary peeling device 200 can comprise one or more rotating brushes (FIGS. 38, 39), longitudinally-extending blades or flaps (FIG. 40); a scraper (FIG. 41); or an abrasive mat (FIG. 42), any of which can be located behind the roller 120 to pull up remaining pieces of film 90. In any embodiment having a secondary peeling device 200 as described herein, remaining pieces of film 90 removed from the surface 92 by the secondary peeling device 200 can be collected manually by an operator, or can be collected in a receptacle as described above.

Figure 43:
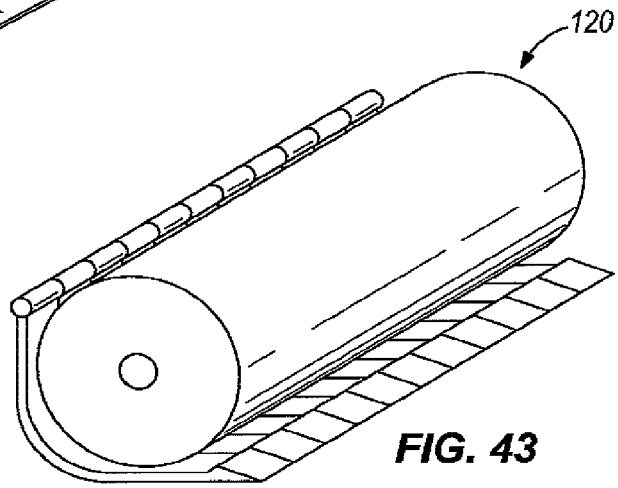
FIGS. 43-51 show different scraping devices and methods for film removal tools according to some embodiments of the present invention.
Figure 44:
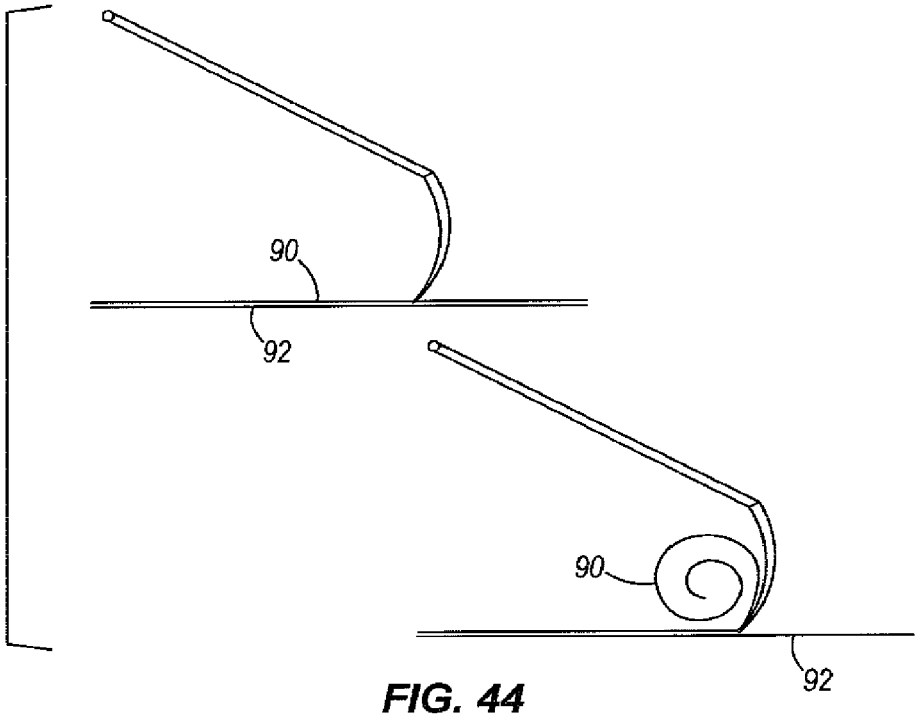
Figure 45:
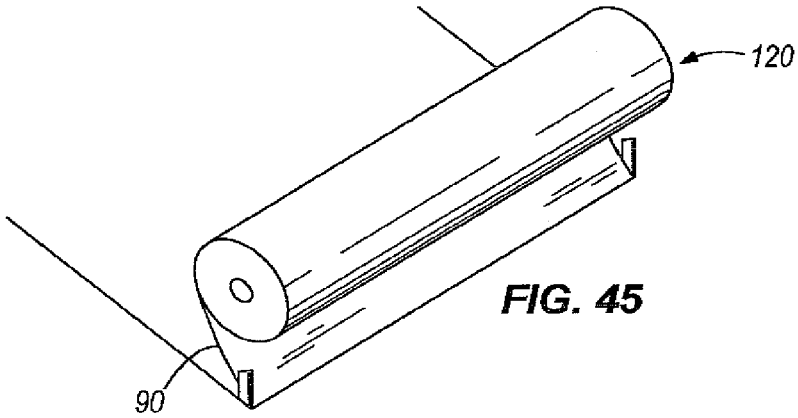
Figure 46:
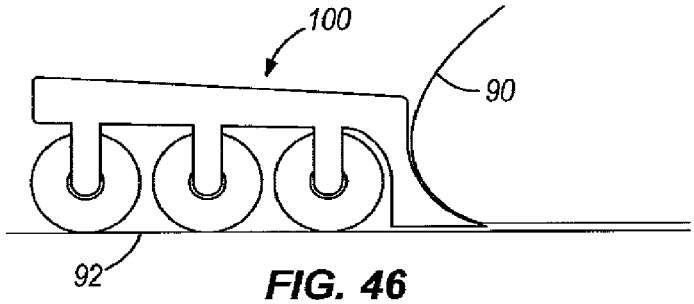
Figure 47:
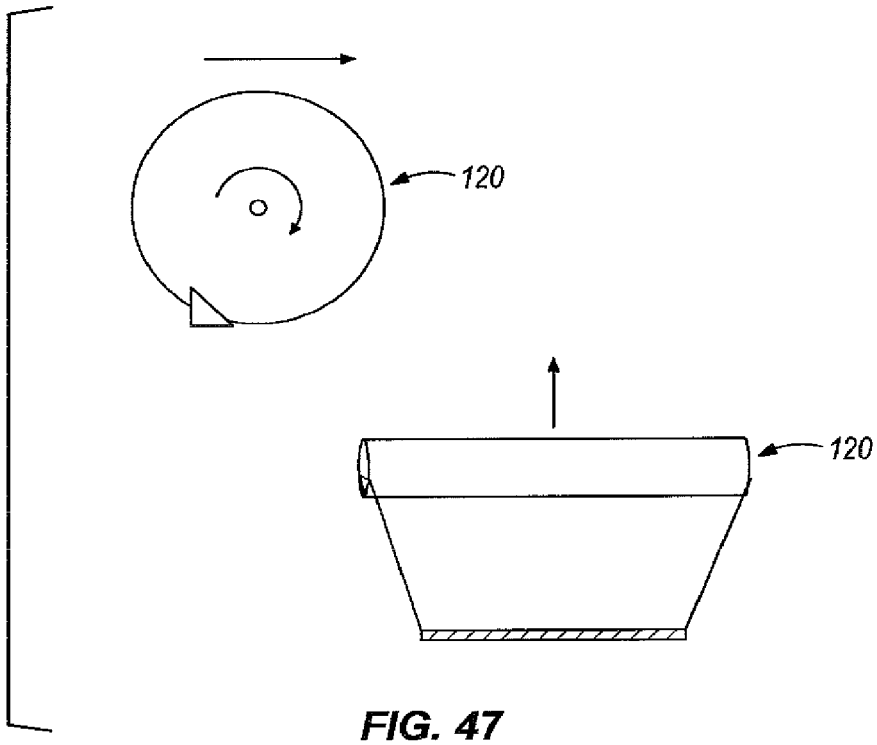
Figure 48:
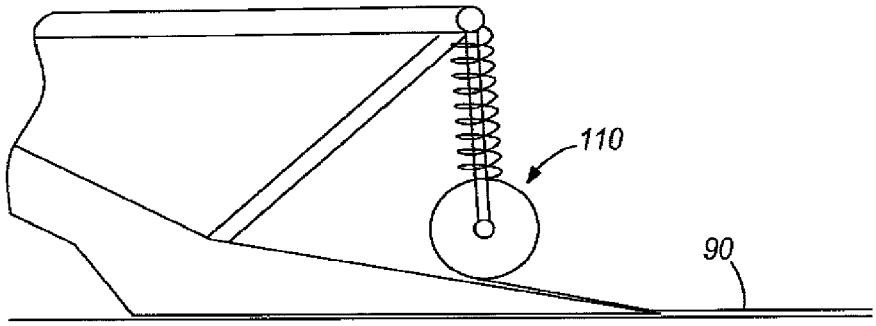
Figure 49:
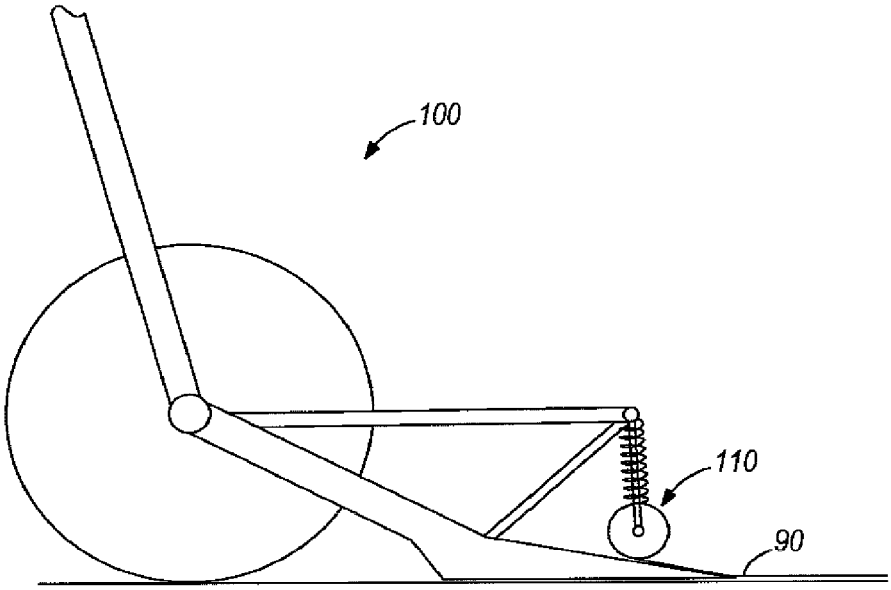
Figure 50:
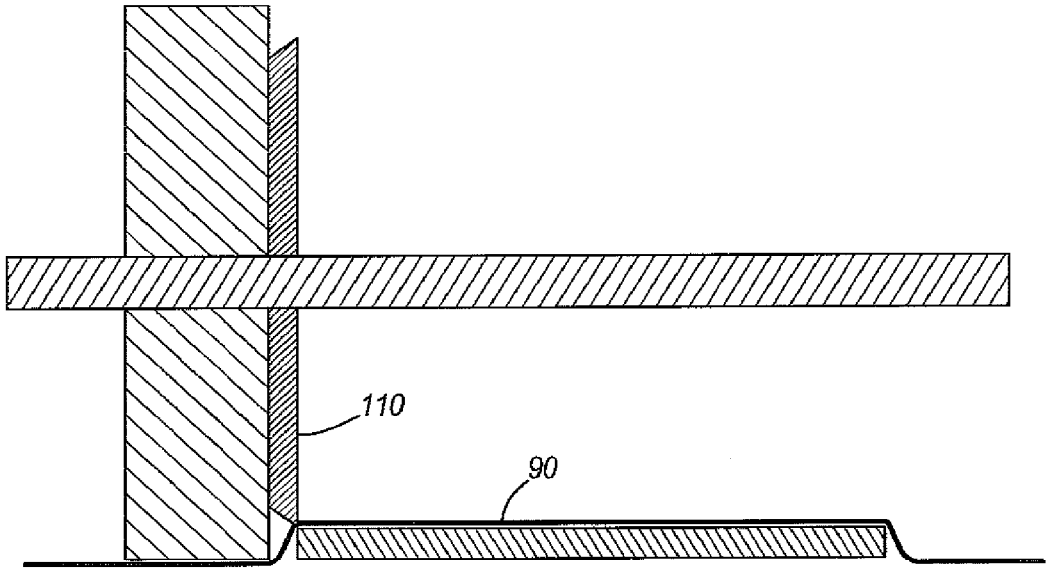
Figure 51:
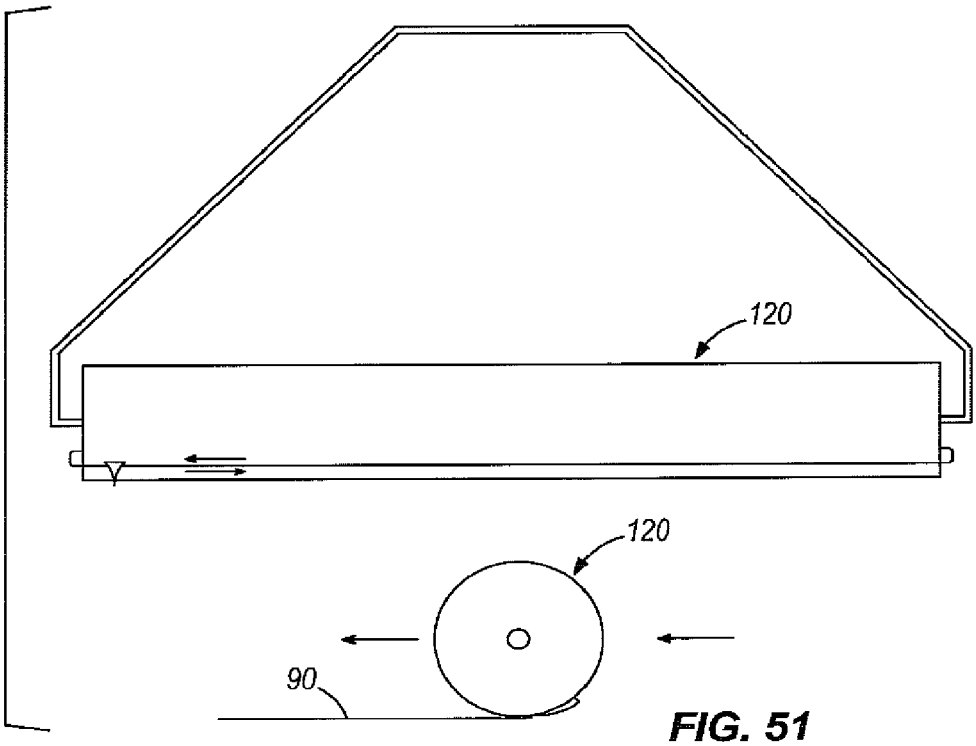

In some embodiments (FIGS. 43, 44, 45, 46), film 90 is scraped from the surface 92, and the roller 120 collecting the film is elevated above the surface 92. In such embodiments, a sharpened scraper edge can be moved across the surface 92 to scrape off the film 90 (FIGS. 44, 46). In some of these embodiments, (e.g., see FIG. 45), the scraper edge, which can be generally parallel to the surface 92, is bent upwards at its outer edges so that edges of the film 90 are cut simultaneous with scraping. In other embodiments (see FIG. 43), the scraping edge comprises a plurality of resilient, independently-movable tangs adjacent one another so that the scraping edge can adapt to uneven surfaces 92.

In those embodiments in which the roller 120 is not in contact with the surface 92, the roller 120 can be rotated in a number of different manners in order to collect the removed film 90. By way of example only, the roller 120 can be powered by an electric motor (battery-operated or otherwise), or can be powered from movement of the tool 100 by indirect coupling to the wheels 104 (e.g., via one or more gears, belts, chains, or other power transmission devices).

In some embodiments, film 90 is lifted from the surface 90 by a scraper or other mechanism, or simply by pulling, and then is cut or scored along edges (see FIGS. 19, 29, 47, 48, 49, 50, 51). By way of example, a scraper can lift the film 90 from the surface 92 as a cutting blade on the side of a wheel of the tool 100 cuts the film 90 by pinching against the scraper (see FIG. 50).

Figure 52:
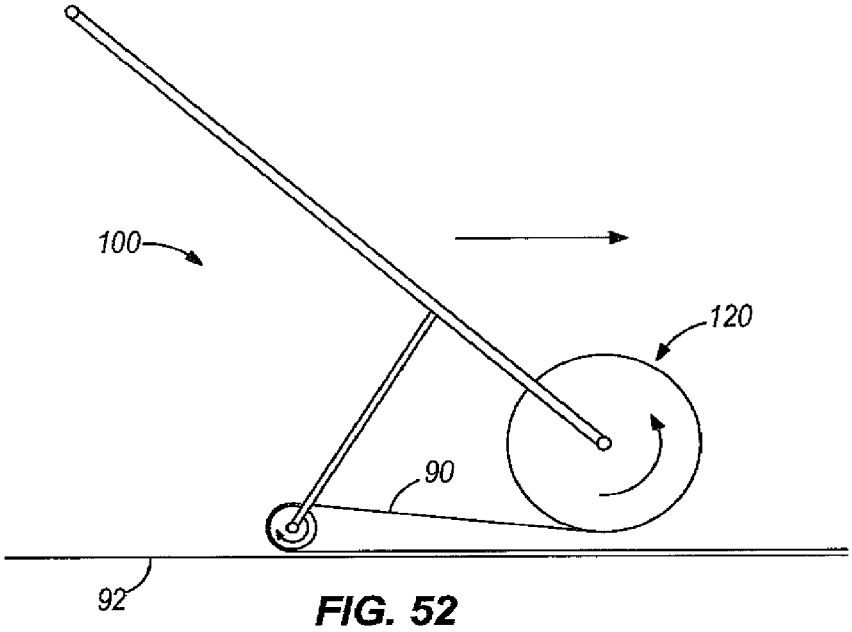
FIG. 52 shows a side view of a film removal tool according to another embodiment of the present invention.
Figure 53:
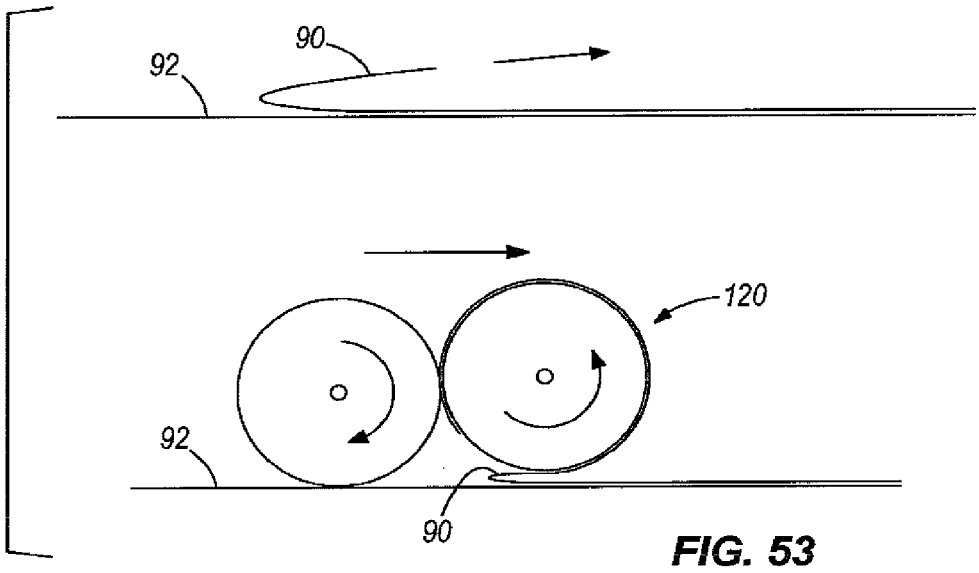
FIG. 53 shows a film removal tool and method according to another embodiment of the present invention.

In some cases, it may be desirable to peel the film 90 at a large angle with respect to the surface 92, such as in a direction generally opposite the direction of tool movement. Thus, in some embodiments, the roller 120 is not in contact with the surface 92, and can rotate in the same direction or in a direction opposite the direction of movement of the tool 100 (see FIG. 52). In such embodiments, the film 90 first winds around a small-diameter idler roller before being collected by the roller 120. In other embodiments, the film 90 is rolled directly from the surface 92 onto a counter-rotating roller 120 adjacent to, but not in contact with, the surface 92 (FIG. 53). In such embodiments, a second roller can contact the surface 92 and the counter-rotating roller 120 to provide movement that collects the film 90.

Figure 54:
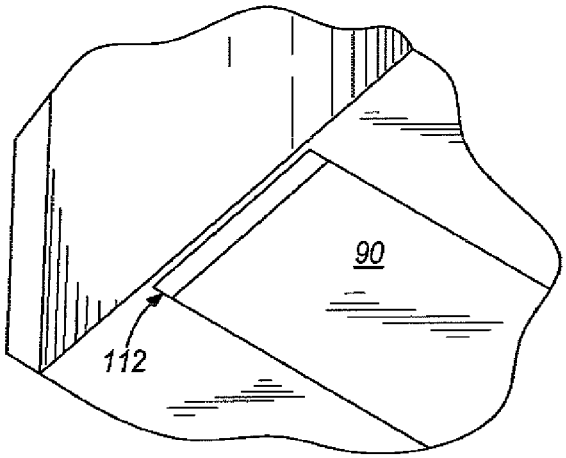
FIG. 54 shows a method of film removal according to some embodiments of the present invention.

In any of the embodiments described and/or illustrated herein, removal of a section of film 90 can be started by scoring or cutting along the edges of a section of film, and applying a strip of tape 112 (e.g., masking tape) at an end thereof (FIG. 54). Thus, lifting the tape 112 (either manually or using the tool 100) can serve to separate the film 90 from the surface 92, and begin a peeling operation.

In some instances, the film 90 can be damaged from wear such that there are holes or scratches that extend completely through the film 90. As a result of such damage, the film 90 may be more difficult to remove, since in its damaged state the film 90 may break into pieces that do not attach well to the roller 120. Thus, in some embodiments, the film 90 can be repaired as needed, e.g. with tape 112, to keep the film 90 together as one piece during removal (see FIG. 55).

Figure 55:
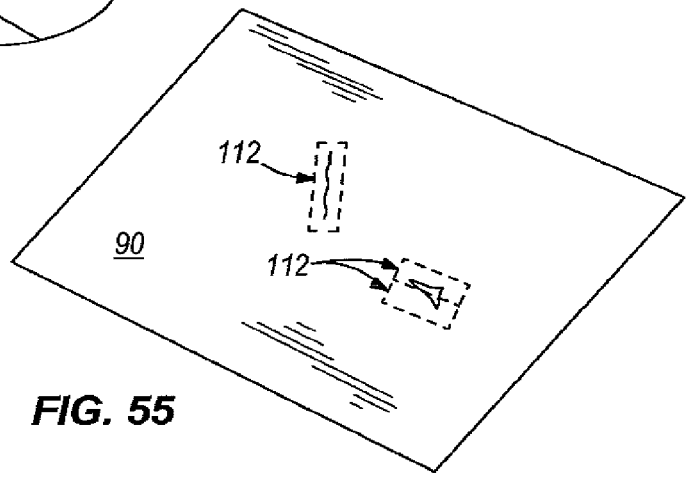
FIG. 55 shows a method of film repair according to some embodiments of the present invention.

FIGS. 56-59 illustrate another embodiment of a tool 100 according to the present invention. This embodiment employs much of the same structure and has many of the same properties as the embodiments of the body support described above in connection with FIGS. 1A-55. Accordingly, the following description focuses primarily upon the structure and features that are different than the embodiments described above in connection with FIGS. 1A-55. Reference should be made to the description above in connection with FIGS. 1A-55 for additional information regarding the structure and features, and possible alternatives to the structure and features of the body support illustrated in FIGS. 56-59 and described below. Structure and features of the embodiment shown in FIGS. 56-59 that correspond to structure and features of the embodiment of FIGS. 1A-55 are designated hereinafter in the 2000 series of reference numbers.

In one embodiment, the tool 100 has a handle 2130 that folds down (FIGS. 58, 59), for example during storage or transport. The folding can be facilitated by hinges 2131 that couple the folding portion of the handle 2130 to the remainder of the handle 2130. The handle 2130 can be stabilized in a given position (e.g. up or down) using known mechanisms such as a screw to tighten the parts together in a given position, a peg that fits into a series of detents, or the like. In other embodiments, part or all of the handle 2130 may be removable, and in still other embodiments the handle 2130 may be telescoping, with one part of the tube sliding within another in order to reduce the height of the handle 2130.

Figure 56A:
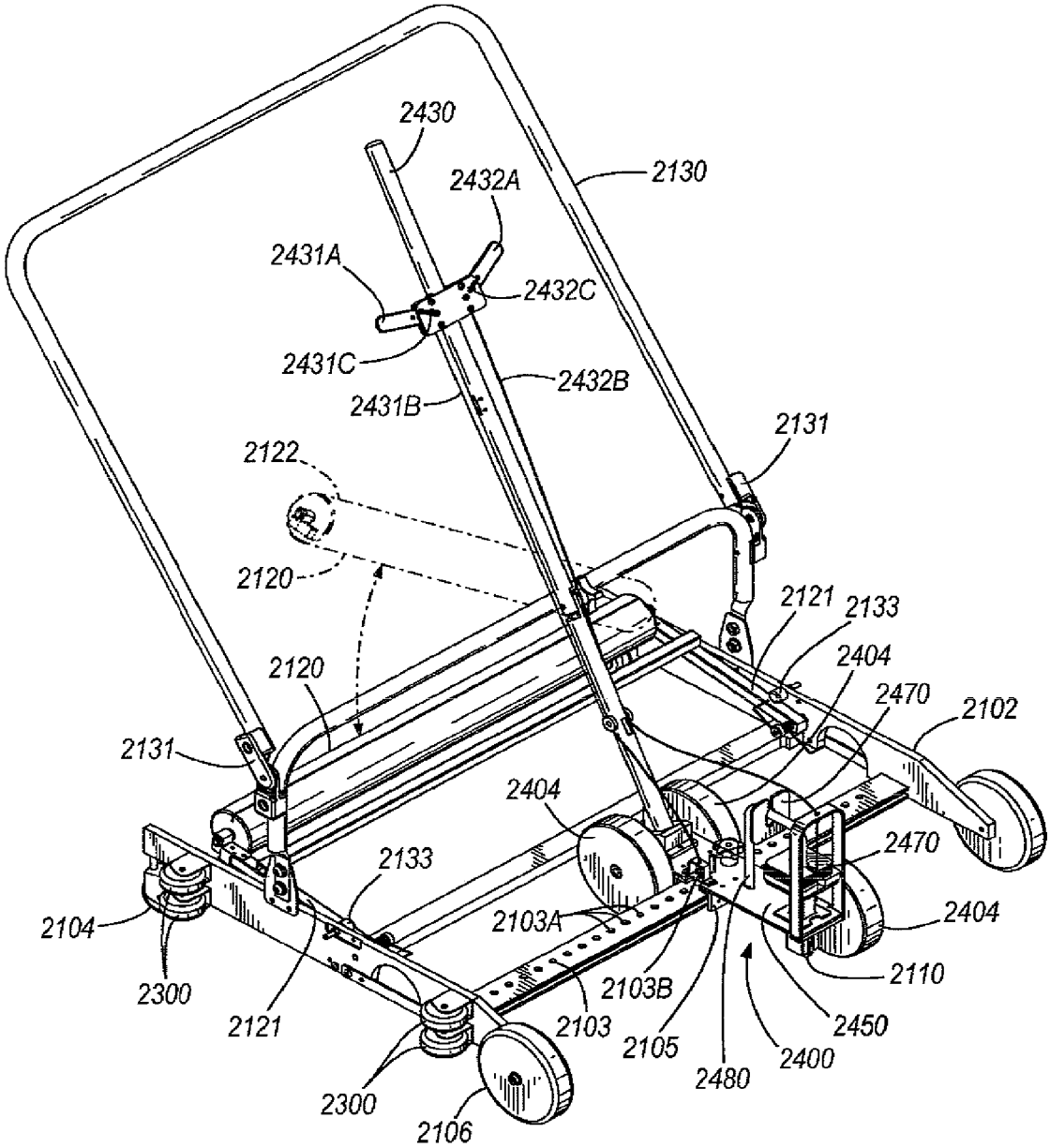
FIG. 56A shows a perspective view of a film removal tool according to an embodiment of the present invention.

In another embodiment, the tool 100 has a frame 2102 which has one or more side wheels 2300 attached on the lateral edge (FIG. 56A). The side wheels 2300 allow the tool 100 to operate close to a wall or other object (e.g. an appliance) without scratching or otherwise harming the surface of the wall or other object. In addition, the tool can be tilted sideways and rolled on the side wheels during transport, especially when moving the tool 100 through a narrow space.

Figure 56B:
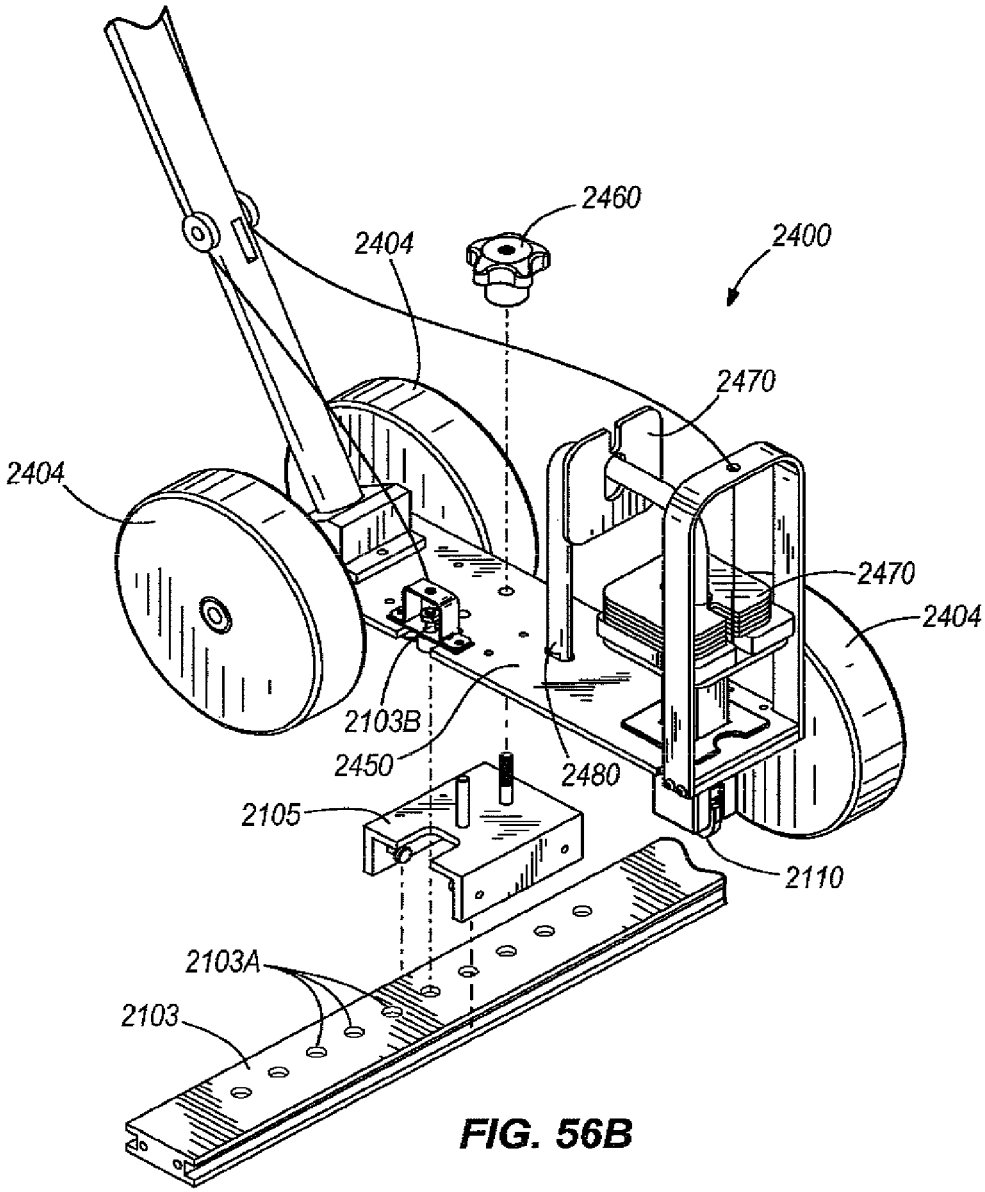
FIG. 56B is a partially exploded detail view of the film removal tool of FIG. 56A.
Figure 57:
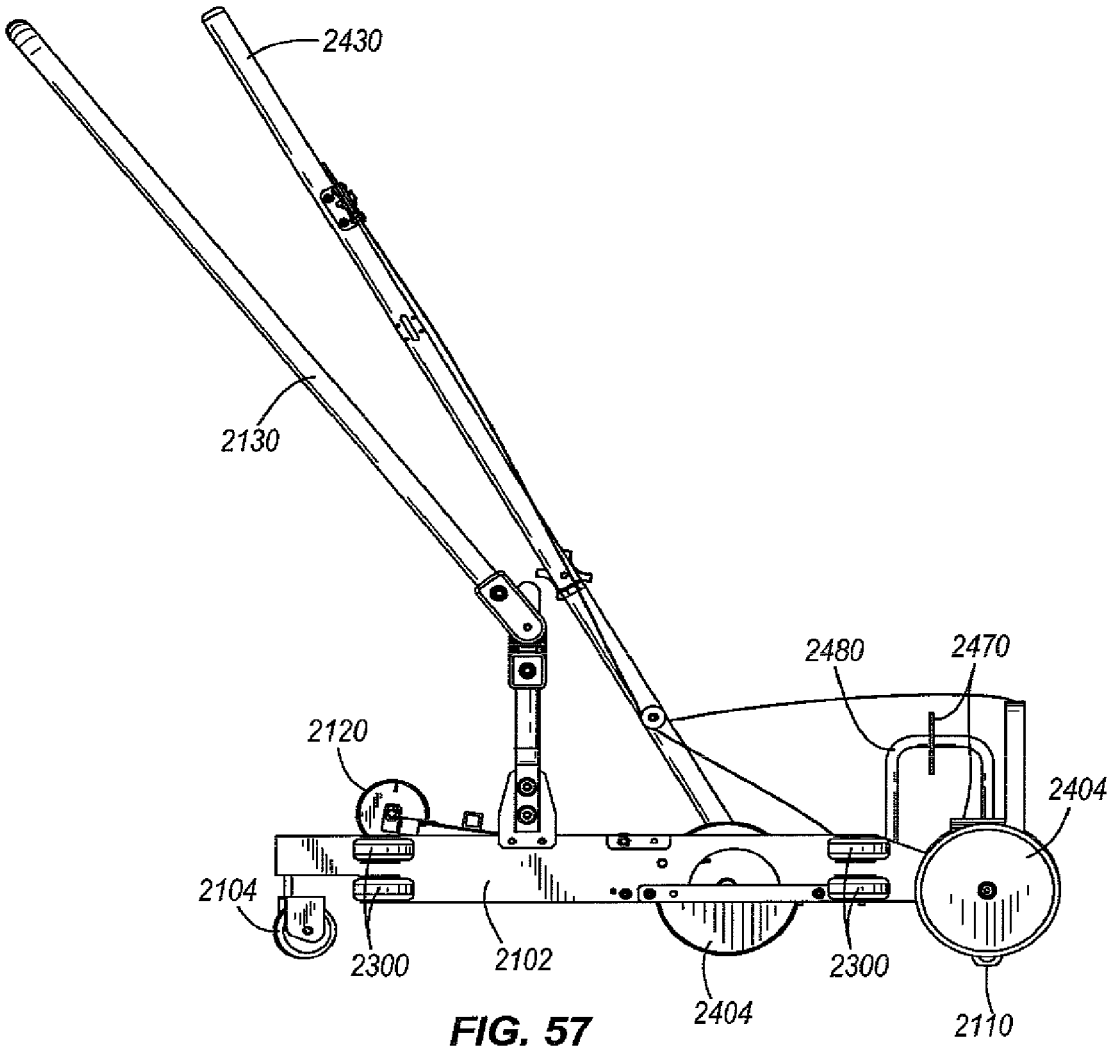
FIG. 57 shows a side view of a film removal tool according to an embodiment of the present invention.
Figure 58:
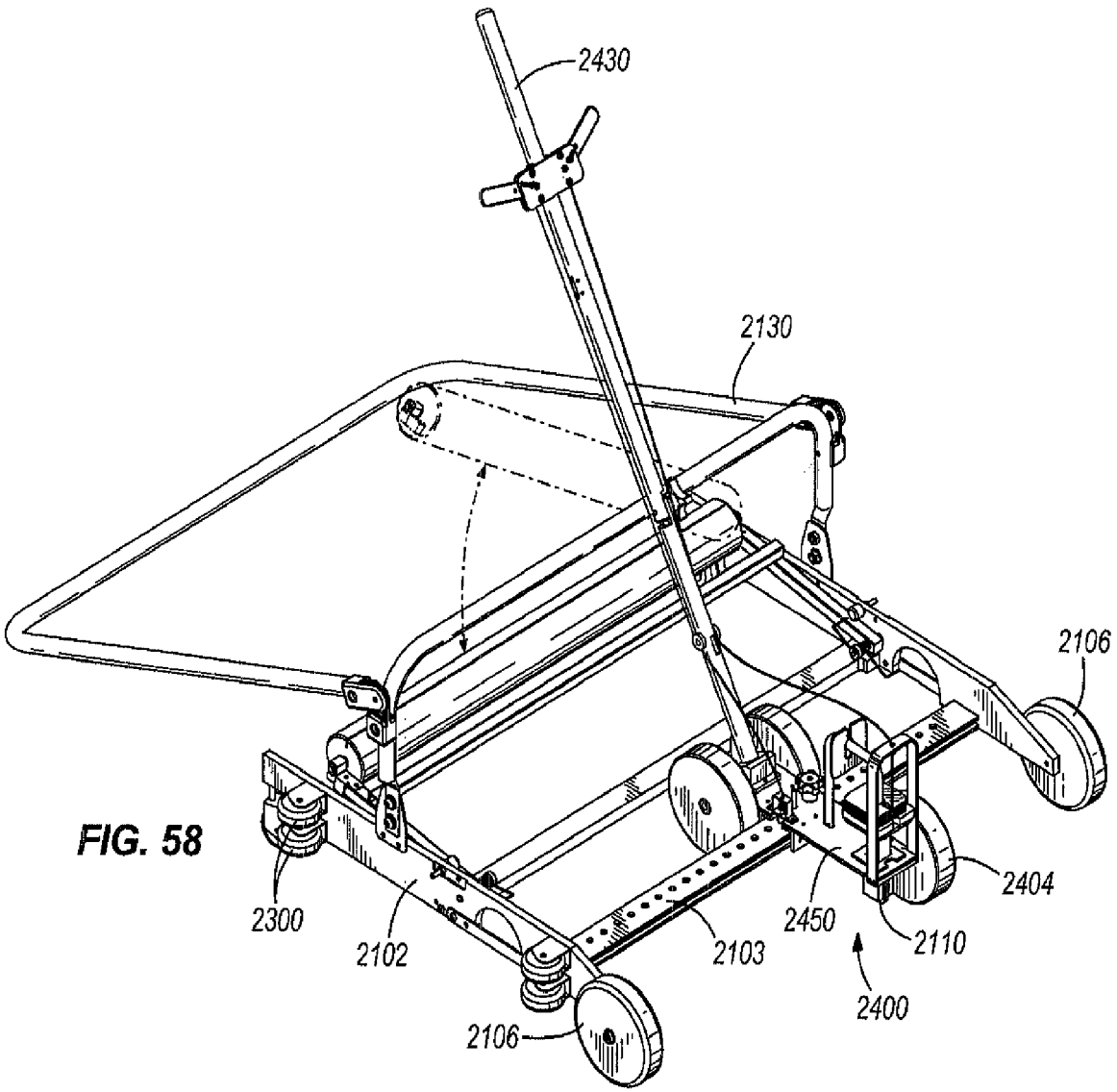
FIG. 58 shows a perspective view of a film removal tool according to an embodiment of the present invention.
Figure 59:
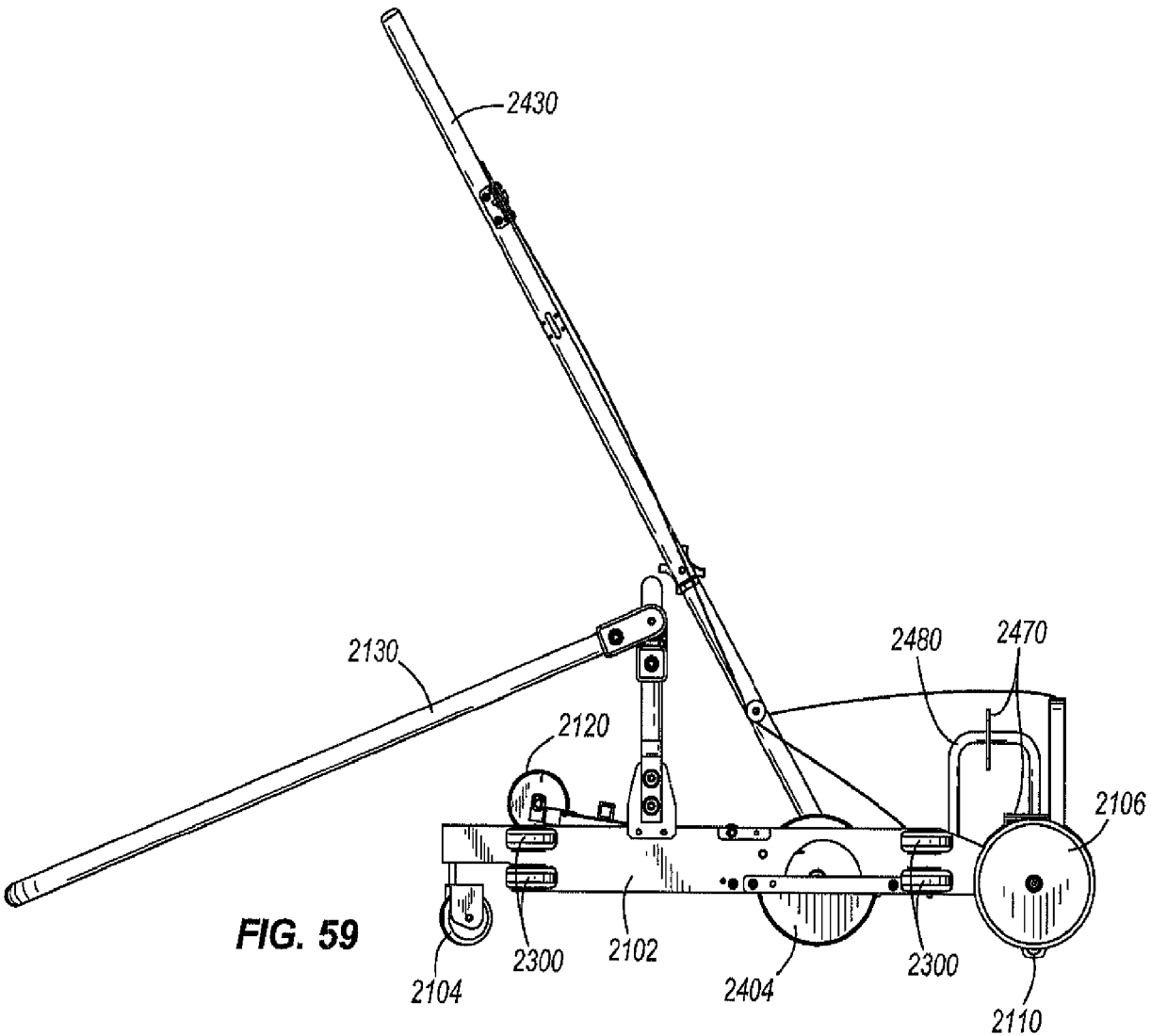
FIG. 59 shows a side view of a film removal tool according to an embodiment of the present invention.

In still another embodiment, the tool 100 includes a detachable portion 2400 which includes one or more wheels 2404, a handle 2430, and a base 2450 to which a blade 2110 is coupled (FIGS. 56A, 56B, 58). The blade 2110 may be wheel with a an outer edge that is adapted for preparing the film 90 for removal, for example by scoring, cutting, or denting. The blade 2110 may be sharpened or rounded at the outer edge. In other embodiments, the blade 2110 may have other shapes. In still other embodiments, the blade 2110 may be a stationary pointed or rounded object or a curve, or the blade 2110 may be a rolling ball bearing at the end of a shaft.

In the embodiment shown in FIGS. 56-59, the detachable portion 2400 of the tool 100 is coupled to the frame 2102 via a crossbar 2103 extending across the front of the frame 2102. In the embodiment shown in FIGS. 56-59, the crossbar 2103 has a sliding bracket 2105 mounted thereon, the sliding bracket 2105 being movable side to side across the crossbar 2103. The sliding bracket 2105 can move relative to the crossbar 2103 by various mechanisms, for example by lubricating the mating surfaces, using ball bearings between the moving portions, fitting a tongue portion of the sliding bracket 2105 into a groove on the crossbar 2103, or some combination of these or other methods.

In order to hold the sliding bracket 2105 in a particular position along the crossbar 2103, thereby laterally positioning the blade 2110, in one embodiment the crossbar 2103 includes a series of detents, teeth, dimples, or the like 2103A for engaging a spring-loaded peg 2103B attached to the base 2450. The spring-loaded peg 2103B is controlled by a handle 2431A via cable 2431B. In one embodiment the spring-loaded peg 2103B is biased by a spring to always engage the detents, teeth, dimples, or the like 2103A except when the handle 2431A pulls the spring-loaded peg 2103B up and away. One or more pulleys or holes may guide the cable 2431B to the spring-loaded peg 2103B. In addition, or instead, the cable 2431B may run through a sleeve that guides and supports the cable 2431B. In some embodiments, the cable 2431B may be a relatively stiff wire that runs through a sleeve and which pushes the spring-loaded peg 2103B towards the detents, teeth, dimples, or the like 2103A via the handle 2431A. In this embodiment the spring-loaded peg 2103B may be biased by a spring away from the detents, teeth, dimples, or the like 2103A in the absence of force being applied by the handle 2431A via the cable 2431B. In various embodiments, the handle 2431A includes a mechanism to hold it in a particular position, e.g. a cam-lock lever 2431C.

The sliding bracket 2105 has a screw projecting upward, over which the base 2450 fits and is secured onto the sliding bracket 2105 by a knob 2460 having threads that are complementary to those of the screw. The detachable portion 2400 can be separated from the frame 2102 by unscrewing the knob 2460 and lifting the base 2450 off the screw of the sliding bracket 2105. In other embodiments, the base 2450 can be coupled to the sliding bracket 2105 by other detachable mechanisms such as clips or magnets. In still other embodiments the sliding bracket 2105 can be fixedly attached to the base 2450 and the sliding bracket 2105 detaches from the crossbar 2103 in order to separate the detachable portion 2400 from the frame 2102.

Separating the detachable portion 2400 from the frame 2102 allows removal of film 90 in tight spaces where the frame 2102 cannot reach and also can permit transport and storage of the tool 100. To further facilitate transport and storage of the detachable portion, whether attached to the tool 100 or not, the handle 2430 in one embodiment is hinged in one or more places so that the handle 2430 can be folded (FIGS. 56-59). As discussed above with regard to folding the handle 2130 attached to the frame 2102, a foldable version of the handle 2430 of the detachable portion 2400 may be secured in a particular folded position using any number of known mechanisms. In the embodiment shown in FIGS. 56-59, the two portions of the handle 2430 that fold relative to one another can be secured by a knob attached to a bolt, which also serves as the pivot about which the handle parts move. In other embodiments the handle 2430 is effectively shortened in other ways, such as by two or more parts of the handle 2430 telescoping together or by the separation and removal of one or more parts of the handle 2430.

The blade 2110 is attached near one end of the base 2450 (FIGS. 56A, 56B, 58). In one embodiment, the blade 2110 is spring-loaded such that a spring pushes the blade 2110 downward into the film 90. The amount of force applied by the blade 2110 can be adjusted by adjusting the tension on the spring. In another embodiment, force on the blade 2110 is produced by placing a series of weights 2470 on the base 2450 at a position over the blade 2110 (FIG. 56A, 56B). The base 2450 in this embodiment is made of a resiliently flexible material that bends slightly in response to weight being applied to one end.

The weights can be attached to the base 2450 by a bracket 2480, such that the weights can be shifted between a central position on the base 2450 where they will not produce significant downward pressure and a forward position over the blade 2110 where they will produce downward pressure (FIG. 56A, 56B). One or more individual weights 2470 may be used, with each weight 2470 weighing the same or each weight 2470 being different, or a combination of same and different weights 2470. The weights 2470 may be easily removable or may be fixedly attached to the bracket 2480, in either case being movable between at least two positions on the bracket 2480. In another embodiment, the weights 2470 are pivotably attached to the base 2450 such that they can be rotated between a central position and a forward position above the blade 2110. In yet another embodiment, the weights are slidably attached to a bar (like beads on an abacus, except with friction so that they maintain their positions) and simply more fore and aft in order to adjust the amount of tension on the blade 2110. In still another embodiment, the attachment of the base 2450 to the sliding bracket 2105 can be adjusted fore and aft in order to adjust the tension on the blade 2110.

The tension on the blade 2110 may be adjusted to accommodate films 90 having different hardnesses and/or different types of underlying surfaces 92. For example, if the underlying surface 92 is softer and/or more prone to being scratched, then the operator of the tool 100 may decrease tension on the blade 2110 to protect the surface 92 during removal of the film 90. In other embodiments, the tension on the blade 2110 is also a function of the type of blade 2110 and whether it is sharp or dull. In some embodiments, the amount of tension applied by to the blade 2110 may be specified by the maker of the film 90. In other embodiments, the weights 2470 may have predetermined values corresponding to different types of films 90 or surfaces 92. In various embodiments, each weight 2470 may be any value between 1 gram and tens of kilograms, or a fraction of an ounce up to tens of pounds. In one embodiment, each weight is 0.25 pounds.

The blade 2110 may be retracted away from the surface 92 when the operator of the tool 100 does not want to score or cut the film 90. In one embodiment, the blade 2110 is retracted by pulling on handle 2432A, which is coupled to cable 2432B, which in turn pulls the blade 2110 upward. As discussed for cable 2431B, in one embodiment the cable 2432B can be a pull-type cable supported by pulleys and/or a sleeve, the handle 2432A and cable 2432B generally pulling against a spring that biases the blade 2110 downward. Alternatively, the cable 2432B can be a stiff push-type cable running through a sleeve to push down on the blade 2110 against an upward-biasing spring. In various embodiments, the handle 2432A includes a mechanism to hold it in a particular position, e.g. a cam-lock lever 2432C.

In one embodiment, a roller 2120 is pivotably attached to the frame 2102 (FIGS. 56-59). The roller 2120 may include a tube 2122 onto which film 90 is wound. The roller 2120 pivots relative to the frame 2102 to make it easier to slide the film 90 and tube 2122 off the roller 2120 for disposal of the film 90 and optionally the tube 2122 as well.

The roller 2120 is pivotably attached to the frame 2102 by a roller support arm 2121, which may be biased toward the frame 2102 by a spring mechanism (FIGS. 56A, 56B, 58). To limit the range of movement of the support arm 2121, particularly if the frame 2102 is rotated into a vertical orientation, there are one or more stops 2133 attached to the frame 2102.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A tool for removing a film from a surface, comprising:
a frame;
a handle coupled to the frame and capable of linearly pushing the frame;
a lever pivotably attached to the handle;
a plurality of wheels coupled to the frame, each of the wheels rotatable about a respective axis;
an arm rotatably coupled to the frame;
a cylinder rotatably coupled to the arm and positioned to collect film from the surface, the cylinder manually driven to wind the film around itself by pushing the handle; and
a blade coupled to the frame and movable into contact with the surface, wherein the blade is coupled to the lever such that moving the lever changes the position of the blade relative to the surface.

2. The tool of claim 1, further comprising a spring operably coupled to the arm and the frame, the spring positioned to bias the arm toward the surface.

3. The tool of claim 1, wherein at least one of the plurality of wheels is pivotably attached to the frame.

4. The tool of claim 1, wherein the cylinder has a sleeve disposed thereon.

5. The tool of claim 4, wherein the sleeve comprises at least one of a rigid tube, plastic film, and paper.

6. The tool of claim 1, wherein the blade is a wheel.

7. The tool of claim 6, wherein the outer circumference of the wheel defining the blade comprises a sharpened edge.

8. The tool of claim 1, wherein the surface is a floor.

9. The tool of claim 8, wherein the film is a peelable polymeric coating disposed on the floor.

10. The tool of claim 1, wherein the blade is removably coupled to the frame by a base.

11. The tool of claim 10, wherein the base comprises a resiliently flexible material.

12. The tool of claim 11, further comprising a weight attached to the base, wherein the weight applies pressure to the blade.

13. A tool for removing film from a surface, comprising:
a frame;
a handle coupled to the frame and by which the tool can be pushed across the surface;
a set of wheels supporting the frame for movement across the surface;
a manually-driven roller supported by the frame and about which the film is wound by movement of the tool across the surface;
a blade coupled to the frame and positioned for contact with the surface;
wherein the frame is movable across the surface by pushing the handle, and wherein movement of the frame across the surface causes the roller to roll atop at least one of the surface and film upon the surface and to wind film upon the roller.

14. The tool of claim 13, further comprising a sleeve upon the roller and about which the film winds.

15. The tool of claim 13, wherein the roller is pulled across the surface by the frame.

16. The tool of claim 15, further comprising an arm upon which the roller is rotatably mounted, the arm extending forwardly of the roller and connected to the frame.

17. The tool of claim 16, wherein the arm is rotatable with respect to the frame.

18. The tool of claim 17, wherein the arm rotates to different positions with respect to the frame to accommodate an increase in a diameter of the roller as film is wound upon the roller.

19. The tool of claim 13, wherein the blade is positioned to cut film on the surface prior to the film being wound upon the roller.

20. The tool of claim 13, wherein the blade is biased toward the surface by a spring.

* * * * *